US008540063B2

(12) United States Patent
LaTowsky

(10) Patent No.: US 8,540,063 B2
(45) Date of Patent: Sep. 24, 2013

(54) WHEELED LUGGAGE WITH EXTENDABLE SUPPORTIVE TONGUE

(76) Inventor: Aaron LaTowsky, Philadelphia, PA (US)

( * ) Notice: Subject to any disclaimer, the term of this patent is extended or adjusted under 35 U.S.C. 154(b) by 912 days.

(21) Appl. No.: 12/255,934

(22) Filed: Oct. 22, 2008

(65) Prior Publication Data

US 2009/0101461 A1 Apr. 23, 2009

Related U.S. Application Data

(60) Provisional application No. 60/981,527, filed on Oct. 22, 2007.

(51) Int. Cl.
*A45C 5/14* (2006.01)
*A45C 13/00* (2006.01)
*A45C 13/04* (2006.01)

(52) U.S. Cl.
USPC ..... 190/18 R; 190/18 A; 280/37; 280/47.29; 280/47.33

(58) Field of Classification Search
USPC ..... 190/18 A, 18 R, 24, 15.1; 280/47.29, 280/37, 38, 47.33
See application file for complete search history.

(56) References Cited

U.S. PATENT DOCUMENTS 3,709,513 A 1/1973 Cassimally
RE28,757 E 4/1976 Cassimally
3,960,252 A 6/1976 Cassimally
3,982,613 A 9/1976 Wood
4,036,336 A 7/1977 Burtley
4,062,429 A * 12/1977 Tabor et al. ..... 190/18 A
4,273,222 A 6/1981 Cassimally et al.
4,348,034 A * 9/1982 Welt ..... 280/35
4,426,099 A * 1/1984 Gross ..... 280/655
4,486,027 A * 12/1984 Carrigan ..... 280/655
4,538,709 A * 9/1985 Williams et al. ..... 190/18 A
4,618,035 A * 10/1986 Mao ..... 190/18 A
4,813,521 A 3/1989 Goldstone
4,995,487 A 2/1991 Plath
5,167,306 A 12/1992 Carrigan, Jr.
5,178,244 A 1/1993 Liang
5,303,805 A * 4/1994 Hauser ..... 190/18 A
5,377,795 A 1/1995 Berman
5,431,262 A * 7/1995 Rekuc et al. ..... 190/18 A
5,433,461 A 7/1995 Chang (Continued)

OTHER PUBLICATIONS

Webpage for "Porter Case . . . with an Invisible CART," from Photography review.com, http://www.portercase.com/index.html, printed Aug. 29, 2007.

*Primary Examiner* — Sue A Weaver
(74) *Attorney, Agent, or Firm* — Saul Ewing LLP

(57) ABSTRACT

Wheeled luggage including an extendable tongue permits use as a hand-truck to transport an additional piece of luggage supported on the extended tongue. The wheeled luggage may be similar to conventional wheeled luggage, but further includes a tongue movable between an inactive and active positions. In the inactive position, the tongue is positioned within a footprint of a bottom of the luggage. In the active position, the tongue extends beyond an outer edge of a bottom of the body to provide supportive structure on which the additional luggage may be placed. The structure of the extendable tongue may have various suitable configurations. A mechanism may be provided for moving the tongue between the inactive and active positions while the user and luggage are in an upright position. An optional strap and/or strap retraction mechanism may be provided to securing the additional luggage.

9 Claims, 41 Drawing Sheets

(56) References Cited

U.S. PATENT DOCUMENTS

| | | | | | |
|---|---|---|---|---|---|
| 5,522,487 | A | | 6/1996 | Nordstrom | |
| 5,560,459 | A | | 10/1996 | Lin | |
| 5,575,362 | A | * | 11/1996 | Franklin et al. | 190/115 |
| 5,749,503 | A | | 5/1998 | Wulf et al. | |
| 5,782,325 | A | | 7/1998 | O'Shea et al. | |
| 5,868,406 | A | * | 2/1999 | Sadow | 280/47.26 |
| 5,875,876 | A | | 3/1999 | Wang | |
| 6,012,729 | A | | 1/2000 | Lin | |
| 6,059,078 | A | | 5/2000 | Nykoluk | |
| 6,098,769 | A | | 8/2000 | Yen | |
| 6,176,559 | B1 | | 1/2001 | Tiramani et al. | |
| 6,220,411 | B1 | | 4/2001 | Scicluna et al. | |
| 6,347,847 | B1 | | 2/2002 | Tiramani et al. | |
| 6,382,375 | B1 | * | 5/2002 | Chang | 190/18 R |
| 6,405,842 | B1 | | 6/2002 | Tsai | |
| 6,561,395 | B2 | * | 5/2003 | Lim et al. | 224/261 |
| 6,575,493 | B1 | * | 6/2003 | Lowenstein | 280/655.1 |
| 6,591,950 | B1 | | 7/2003 | Scicluna | |
| 6,601,930 | B2 | | 8/2003 | Tiramani et al. | |
| 6,702,164 | B1 | * | 3/2004 | De Lathouwer | 224/153 |
| 6,742,636 | B2 | | 6/2004 | Godshaw | |
| 6,802,409 | B1 | | 10/2004 | Tiramani et al. | |
| 2004/0031654 | A1 | * | 2/2004 | Chang | 190/18 A |

* cited by examiner

WHEELED LUGGAGE WITH EXTENDABLE SUPPORTIVE TONGUE

CROSS-REFERENCE TO RELATED APPLICATIONS

This application claims the benefit of priority of U.S. Provisional Patent Application No. 60/981,527, filed Oct. 22, 2007, the entire disclosure of which is hereby incorporated herein by reference.

FIELD OF THE INVENTION

The present invention relates generally to luggage, and more particularly to wheeled luggage.

BACKGROUND OF THE INVENTION

Various forms of suitcases, bags, and totes (collectively, "luggage") are well known in the art for travel, business and general purpose uses. Of all such varieties of luggage, there is a well-known class of wheeled luggage, which typically includes at least two wheels that may be used to roll the luggage along the ground. The wheels are often of a swivelable caster style, or a fixed, in-line skate style. Many such bags further include an extendable handle for use to tilt the bag from an upright position onto its wheels, and to provide a convenient handle by which to pull the bag along as it rolls on its wheels. Examples of such wheeled bags are shown in U.S. Pat. Nos. 4,995,487, 5,560,459 and 6,802,409, the entire disclosures of which are hereby incorporated herein by reference.

Such arrangements have been found to provide a significant improvement of the conventional luggage carried by a handle, and acceptance of such wheeled luggage has been widespread. However, conventional wheeled luggage makes it particularly difficult to transport more than one bag simultaneously, e.g. through an airport, etc. For example, it is difficult to transport three or more wheeled bags with only two hands. Further, it is difficult to transport one wheeled bag while carrying another, non-wheeled bag.

It has been observed that some individuals will stack, to the extent feasible, other, usually smaller, bags on top of the wheeled luggage, typically between the top of the bag and the handle. However, such an arrangement is unstable in that the stacked bag tends to slip out of its intended position atop the wheeled luggage. Additionally, such an arrangement places excessive strain on the hand and wrist gripping the handle as a result of the weight of the added bag. Further, the size of the bag that can be placed in this manner is limited by the length of the handle and the size of the wheeled luggage.

What is needed is improved wheeled luggage that is helpful to travelers or others that need to easily transport multiple pieces of luggage, particularly multiple pieces of large luggage.

SUMMARY OF THE INVENTION

An embodiment of the present invention provides wheeled luggage including an extendable tongue. The luggage may have a structure generally similar to that of any suitable conventional wheeled luggage, and thus may include a frame or partial frame, a nylon or other body having one or more soft or rigid panels substantially enclosing the frame and having at least one flap closeable by a zipper closure, an extendable handle, and at least two wheels mounted to the frame. In accordance with the present invention, the luggage further includes a tongue that is movable between a retracted/folded/unattached or stored position (collectively, an "inactive position") and an extended/unfolded/attached or deployed position (collectively, an "active position"). In the inactive position, the tongue is positioned within the luggage, or within a footprint (inside or outside of the body) of a bottom of the luggage. In the active position, the tongue extends beyond the dimensions of the body, e.g. beyond an outer edge of a bottom of the body, opposite the wheels, of the luggage to provide supportive structure on which an additional piece of luggage may be placed, adjacent the body of the wheeled luggage. The handle, wheels and tongue of the wheeled luggage may then be used in a manner similar to a hand truck to conveniently transport the additional piece of luggage, in tandem with transporting of the wheeled luggage body. The positioning of the additional luggage in this manner places much of the weight of the additional luggage directly over the wheels during normal toting, and thus places only limited strain on the hand and wrist of the individual. Additionally, at least two pieces of luggage may be transported using only a single hand, allowing for transporting of 4 large pieces of luggage (e.g., for a family of 4) by a single person, e.g., a parent.

Optionally, the luggage may include a mechanism for remotely initiating movement of the tongue between the active and inactive positions. For example, the mechanism may have a user-operable handle located near the extended handle to permit operation of the mechanism/tongue from a standing position.

The wheeled luggage may include a strap adjustably securable to itself or another portion of the wheeled luggage to cinch the additional luggage against the wheeled luggage to maintain stability during transporting of the bags. The strap may be provided in conjunction with a strap retraction mechanism.

Although the present invention may be particularly suitable for use with relatively large luggage, it will be appreciated that it is applicable to a wide range of luggage, bags, briefcases, etc.

BRIEF DESCRIPTION OF THE DRAWINGS

The present invention will now be described by way of example with reference to the following drawings in which.

DETAILED DESCRIPTION

Figure 1:
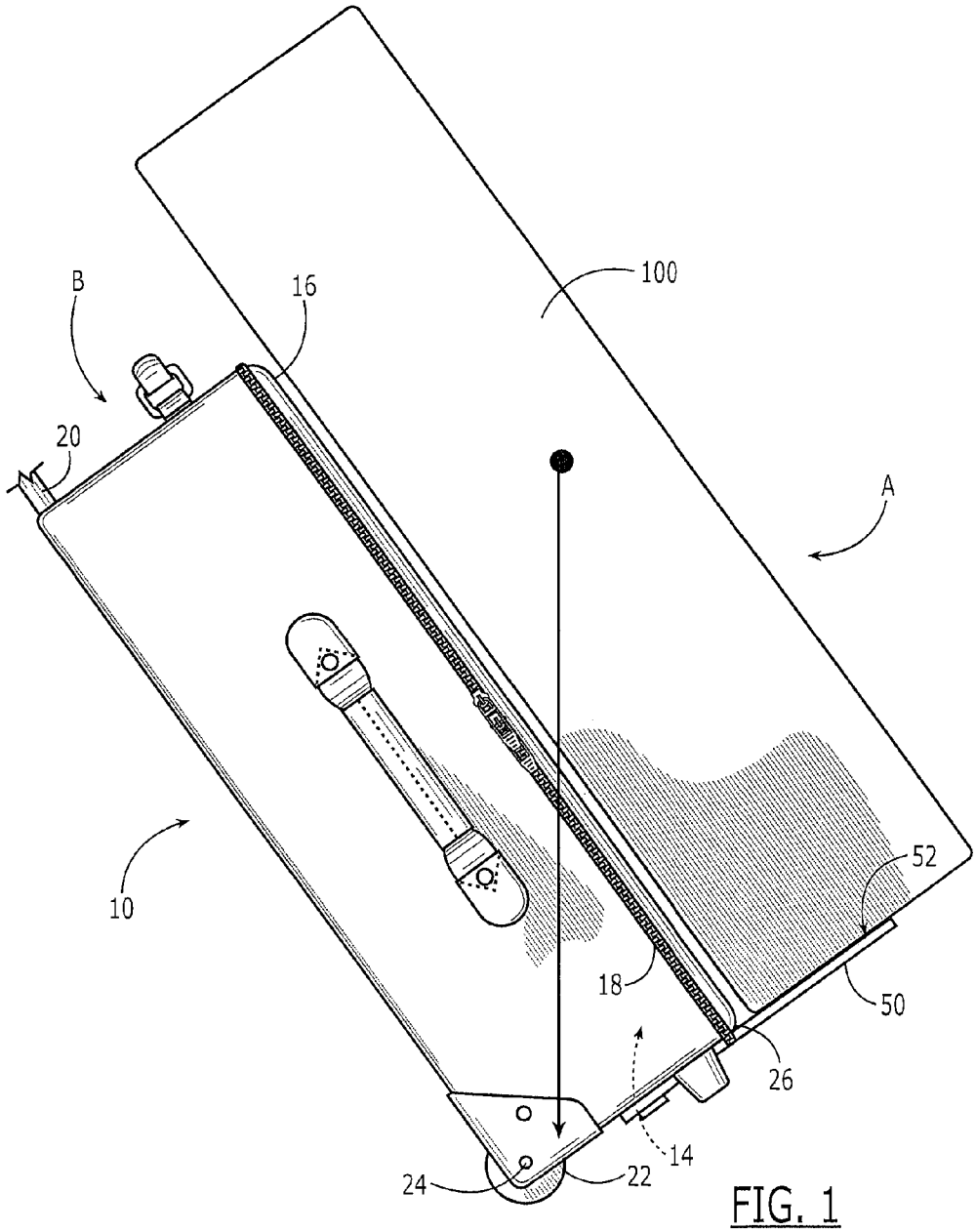
FIG. 1 is a side view showing exemplary use of an exemplary embodiment of wheeled luggage in accordance with the present invention.

The present invention provides wheeled luggage 10 that is similar to conventional wheeled luggage in many respects. Unlike conventional wheeled luggage, wheeled luggage in accordance with the present invention includes an extendable tongue 50 that enables the wheeled luggage 10 to be used similarly to a hand truck to carry at least one additional piece of luggage 100 supported on the extended tongue 50, as shown diagrammatically in FIG. 1.

The luggage 10 may have a structure generally similar to that of any suitable conventional luggage, and thus may include, for example, a flexible nylon, textile, or other "soft" (as contrasted with rigid plastic, rigid fiberglass, etc.) body 12 enclosing an internal space 14 into which clothing, papers, a notebook computer or other objects may be placed for transport. As is conventional, the body 12 may include one or more panels forming a body similar to a hard- or soft-bodied suitcase, and including at least one flap 16 closeable by a zipper or other closure 18. The body 12 may have any suitable shape, but in this example defines a generally rectangular volume and thus has panels forming a front, a back, a top, a bottom, a left side, and a right side. Additionally, the luggage 10 may include a fixed or collapsible handle 20, the collapsible handle being extendable from a compact stored position to an extended operable position, and at least two wheels 22 mounted for rotation about a common axis 24 to provide rolling support for the luggage. Such structures, suitable materials, construction techniques etc. are well known in the art and thus are not discussed here in detail. Any suitable such structures may be employed, as desired.

Figure 2:
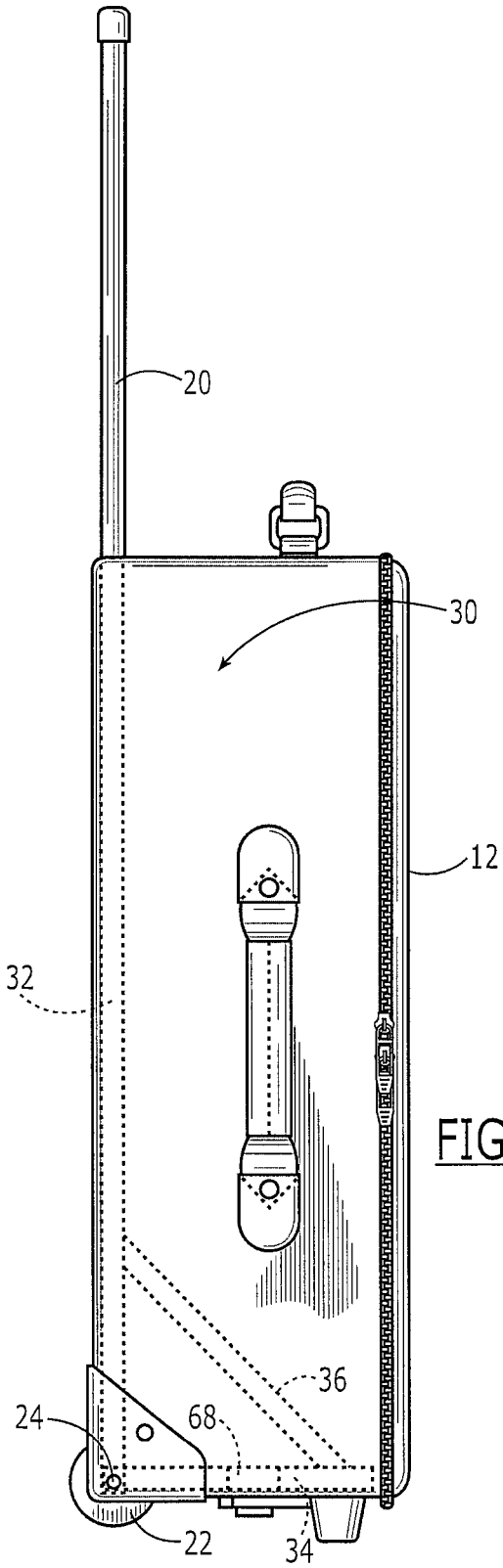
FIG. 2 is a side view of an exemplary frame of the wheeled luggage of FIG. 1.

In an exemplary embodiment of the present invention, the luggage 10 includes a rigid frame 30 supporting the wheels 22, as best shown in FIG. 2. Preferably, the frame 30 includes at least an upright member 32 connected to a base member 34. Optionally, a support member 36 extends between the upright member 32 and the base member 34 to enhance the structural rigidity of the frame 30. The upright member 32 provides support for the handle 20, and the base member 34 provides support for the tongue 50, as discussed in greater detail below. Accordingly, handle 20 and upright member 32 can be used to provide leverage for tilting the additional luggage 100 loaded onto the tongue 50 about the wheels 22.

In accordance with the present invention, the luggage 10 further includes a tongue 50 as shown in FIG. 1. The tongue 50 is preferably movable between an inactive position and an active position. In the inactive position, the tongue is positioned within a footprint (as viewed from the top) of the luggage when in the upright position, such that it will not protrude substantially beyond the overall dimensions of the body, e.g., beyond an outer edge 26 (see FIG. 1) of the body 12, so that it is unlikely to catch on nearby objects, damage other luggage, etc. In the active position, the tongue 50 extends beyond the dimensions of the body 12 of the luggage 10 to provide supportive structure having a supportive surface 52 onto which an additional piece of luggage 100 may be placed, adjacent the body 12 of the wheeled luggage, as shown in FIG. 1. The wheeled luggage may then be used in a manner similar to a hand truck to conveniently transport the additional piece of luggage 100, in tandem with transport of the wheeled luggage 100, as shown in FIG. 1.

Referring again to FIG. 1, the positioning of the additional luggage 100 in this manner (in region A) places much of the weight (as illustrated by showing an approximate center of gravity (CG)) of the additional luggage 100 substantially directly over the wheels 22 during normal toting, which places substantially less strain on the hand and wrist of the individual grasping the handle, as compared with placement of any luggage in region B. Additionally, in this arrangement, at least two pieces of luggage may be transported using only a single hand, allowing for transporting of 4 large pieces of luggage (e.g., for a family of 4) by a single person, e.g., a parent, using both hands.

It should be noted that this manner of construction provides wheeled luggage including a rigid assembly, including the handle, upright member of the frame, base member of the frame, tongue, and wheels, for manipulating and carrying any additional luggage by way of the handle. In this manner, the wheeled luggage does not rely upon any rigidity of the luggage body itself, or any strength of luggage body hinges, luggage body closures, etc. Further, this configuration permits the luggage body to be opened, e.g. to provide access to the internal space, while maintaining its ability to transport additional luggage.

The tongue may have various configurations, several of which are illustrated in the exemplary alternative embodiments discussed below. These exemplary alternative embodiments are generally similar in structure to the embodiment shown in FIGS. 1 and 2 in that they include structures providing an extended tongue, opposite the wheels, for supporting an additional piece of luggage. For simplicity and ease of understanding, salient differences in each of these embodiments as discussed below, without repeating of description of similar structures.

Figure 3A:
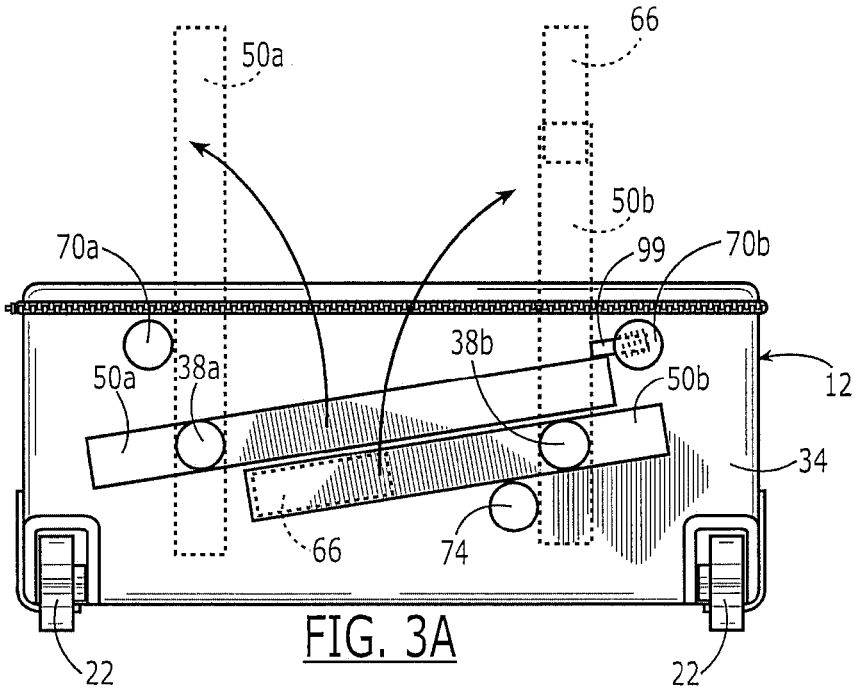
FIGS. 3*a* and 3*b* are bottom and side views, respectively, of the wheeled luggage, including a pivoting-bar style tongue.
Figure 3B:
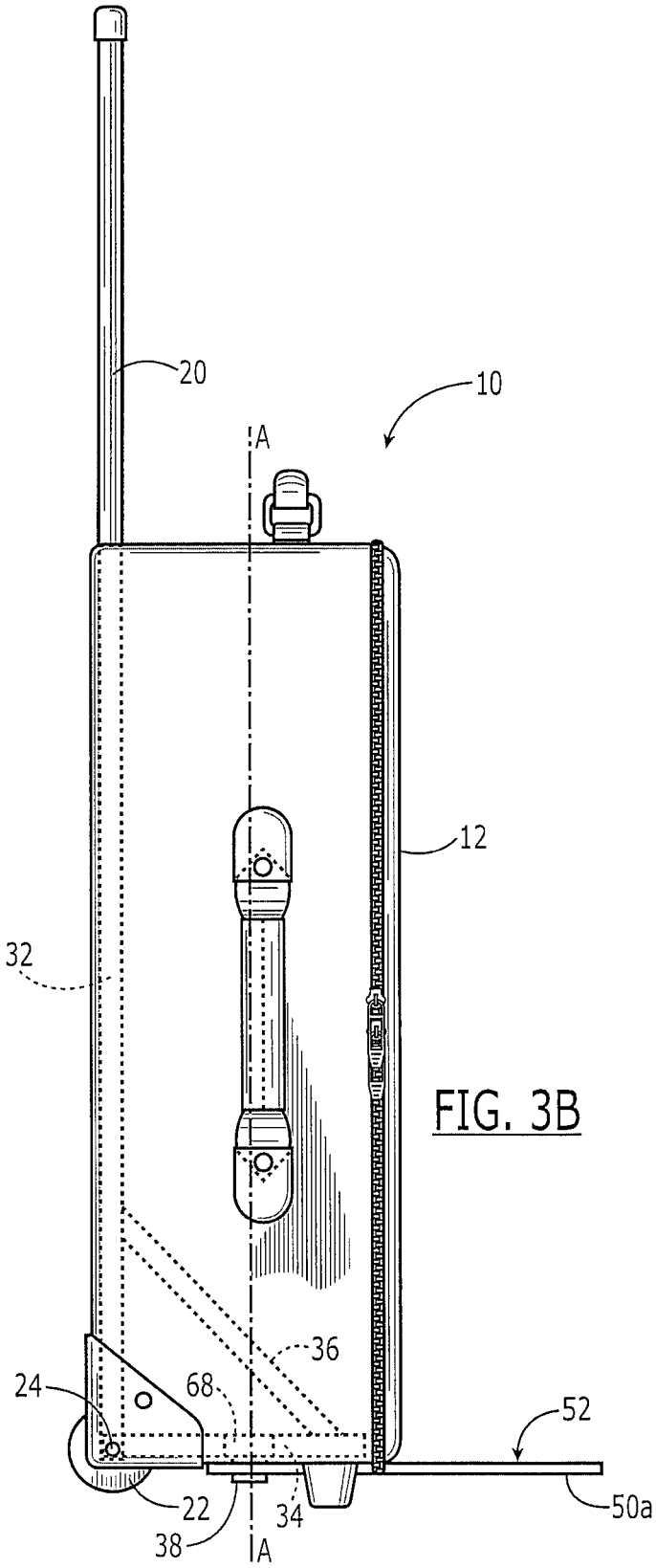

FIGS. 3*a* and 3*b* are bottom and side views, respectively, of wheeled luggage 10 including a pivoting-bar style tongue 50. In this embodiment, the base member 34 of the frame may include a substantially flat plate and may be positioned internally to or externally to the body 12. At least one bushing 38 is supported on, and located eccentrically to, the base member 34, as shown in FIG. 3*a*. As shown in FIGS. 3*a* and 3*b* each tongue includes at least one, and in this embodiment two, rigid tubes or bars (collectively, "bars") 50*a*, 50*b* supported on the bushing 38 and pivotable about an axis A that is substantially vertical when the luggage is in the upright position, as shown in FIG. 3*b*. More specifically, each bar 50*a*, 50*b* may include a fixed pin that rotates within the bushing. Accordingly, the bars 50*a*, 50*b* are pivotable from the inactive position shown in FIG. 3*a*, to the active position shown in FIG. 3*b*. Preferably, each of the bars has a length greater than a distance between the bushings, and each bushing is disposed intermediate the length of a respective bar. Thus, a first portion of the bar extends from the bushing to outside of the footprint to provide supportive structure for additional luggage, and a second portion of the bar, opposite the first portion relative to the bushing, abuts the base member, in the event of any pivoting or displacement about the bushing, to provide support for the additional luggage.

Legs 70*a* and 70*b* serve as legs for supporting the suitcase in an upright position. The leg 70*a* is are positioned to act as a stop limiting pivoting movement of bar 50*a* about bushing 38*a*. Somewhat similarly, stop 74 is positioned to act as a stop limiting pivoting movement of bar 50*b* about bushing 38*b*. Leg 70*b* is provided with a spring-biased latch 99 that is biased into a position to retain bars 50*a* and 50*b* in a retracted position, as shown in FIG. 3A. Stop 74 may abut bar 50*b* in the retracted position, as shown in FIG. 3A.

Optionally, bar 50*b* may be shorter than bar 50*a* to permit clearance with bushing 38*a* when pivoting to the operable position, and may further include a sliding extension member 66 that is normally housed within bar 50*b*, as shown in FIG. 3A. The sliding extension member 66 may be extended such that the overall length of bar 50*b* substantially matches that of bar 50*a*. The sliding extension member may be latched in extended or retracted positions in any suitable manner, e.g., using a spring-biased detent mechanism.

Figure 4A:
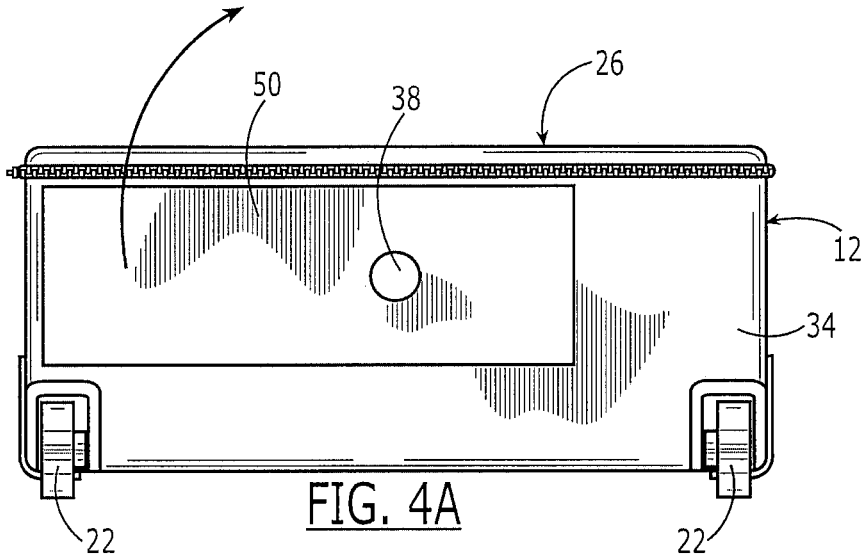
FIGS. 4*a*-4*f* illustrate an alternative embodiment of wheeled luggage include a pivoting-bar style tongue.
Figure 4B:
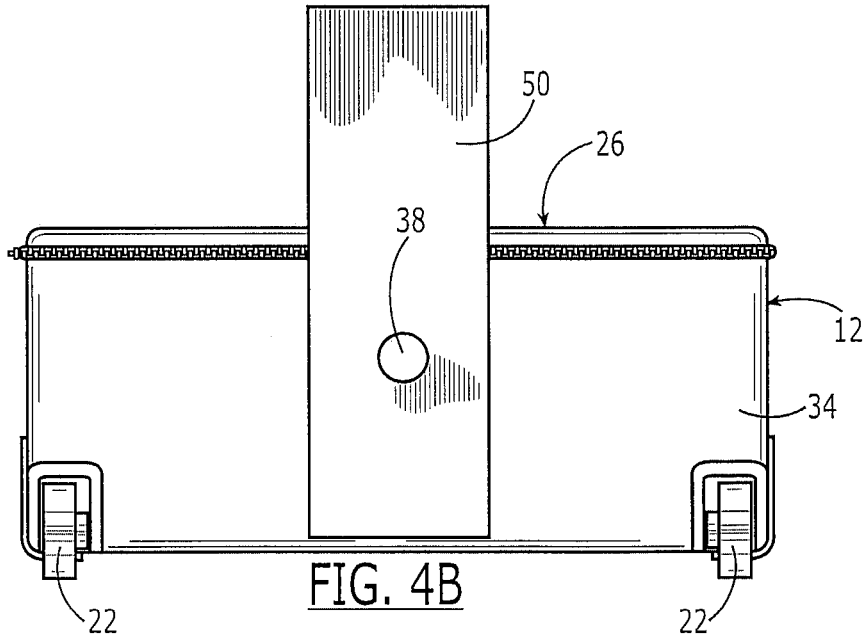
Figure 4C:
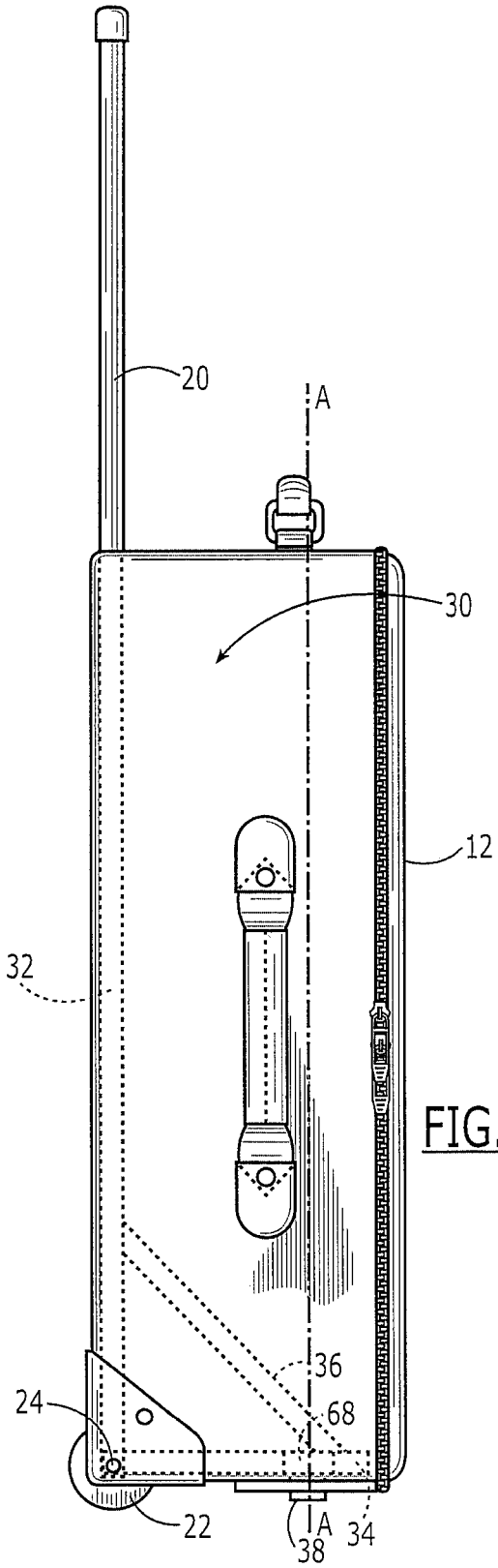
Figure 4D:
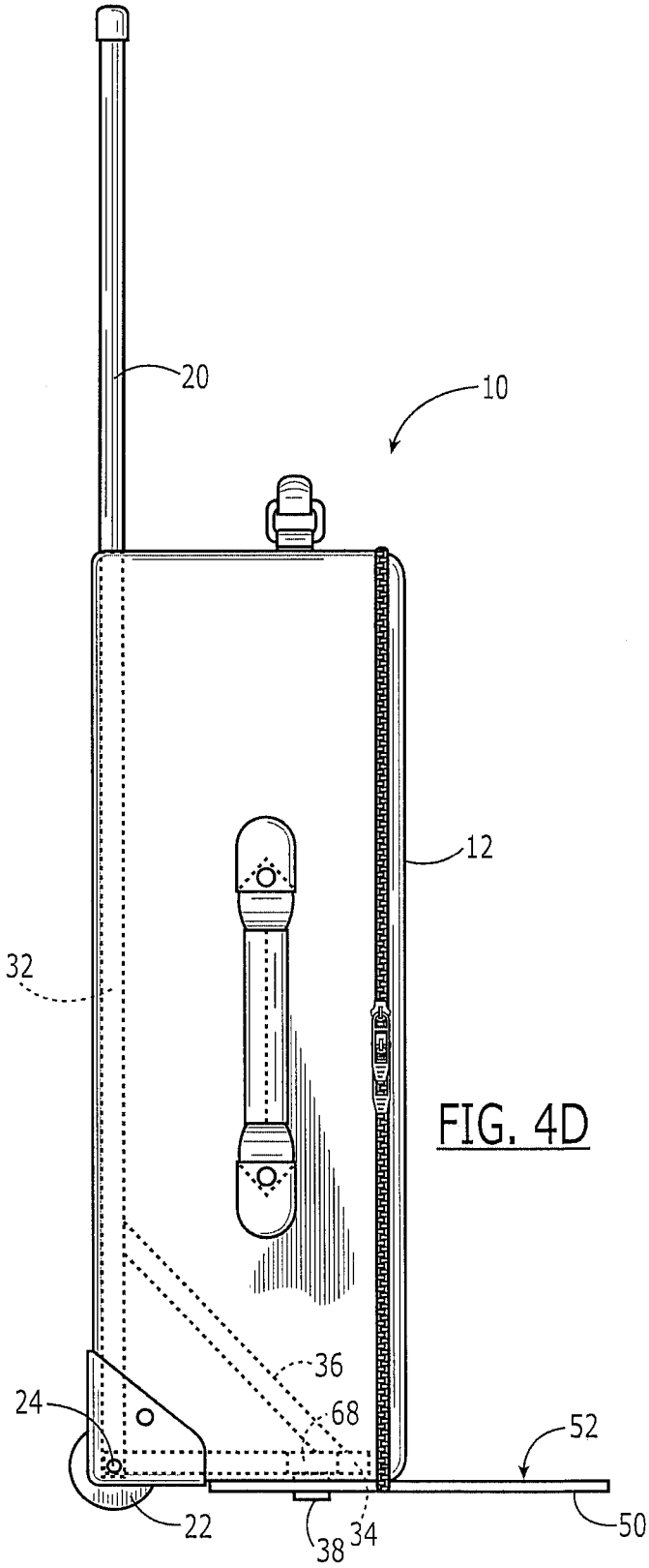
Figure 4E:
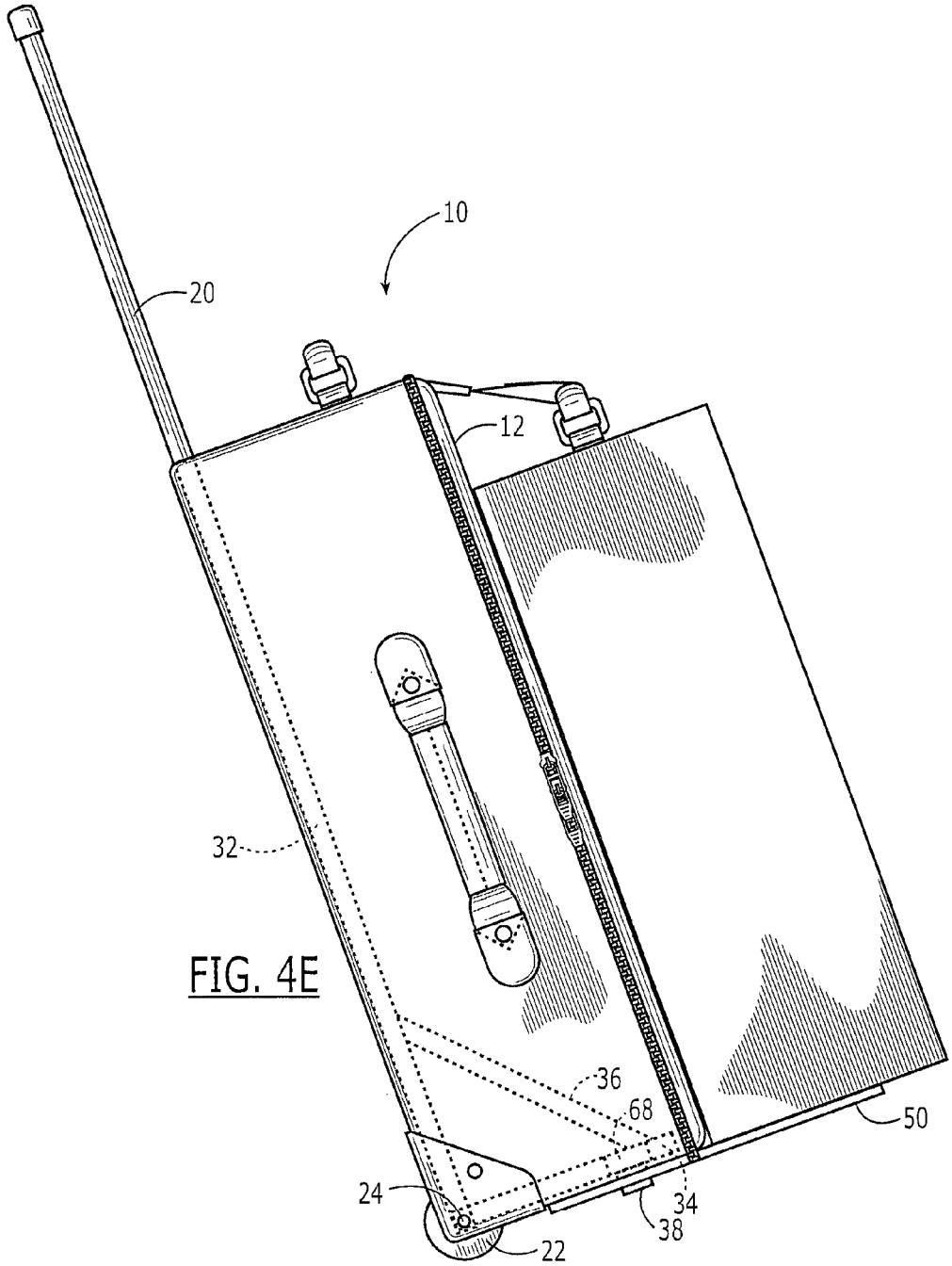
Figure 4F:
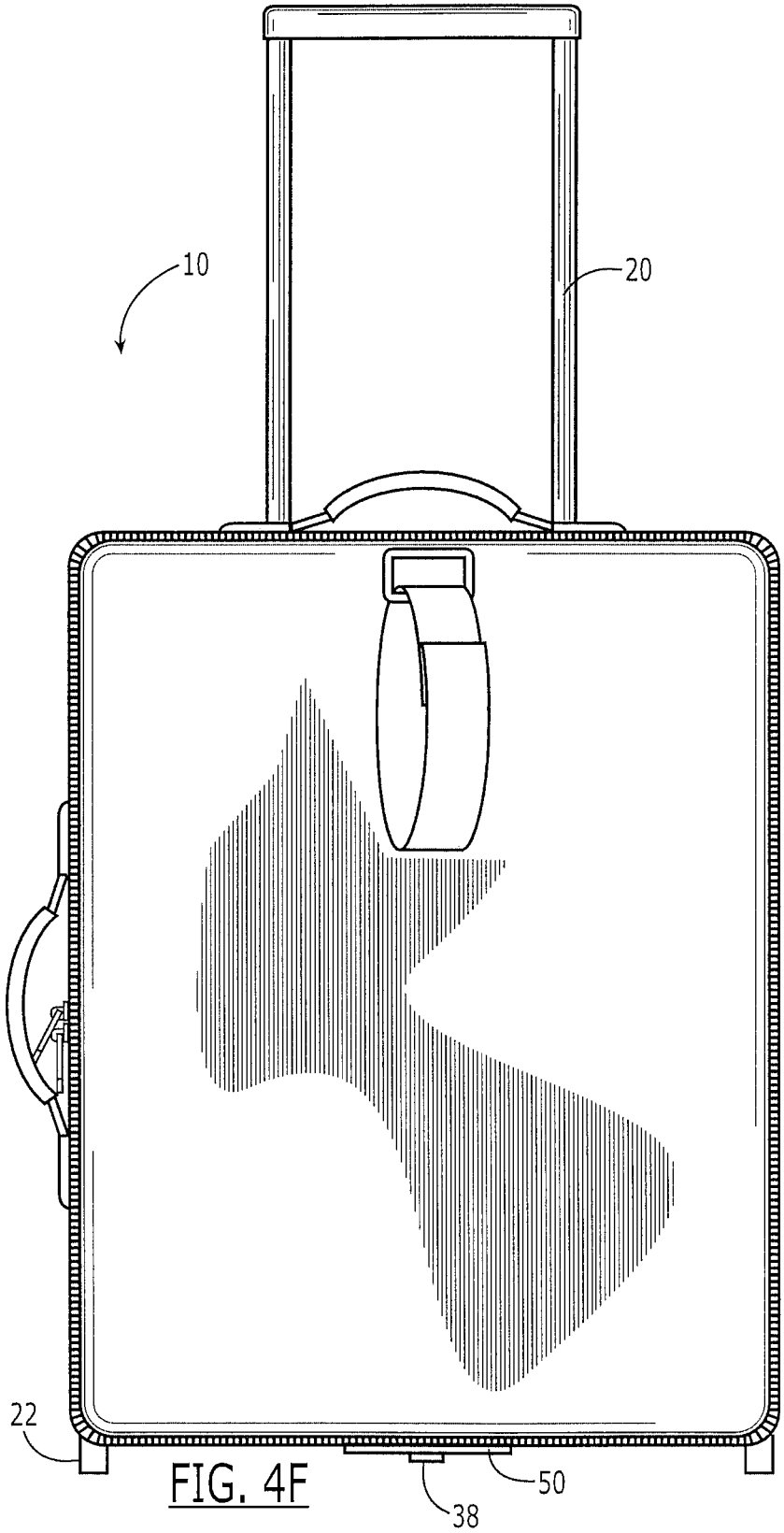

FIGS. 4*a*-4*f* illustrate an alternative embodiment including a pivoting-bar style tongue 50. In this embodiment, the base member 34 may be substantially flat, similar to that of FIGS. 3*a* and 3*b*. Additionally, this embodiment includes a single bushing 38 supported on, and located centrally to, the base member 34. The tongue includes one rigid, broad plate-like bar 50 supported on the bushing 38 and pivotable about an axis A that is substantially vertical when the luggage is in the upright position, as shown in FIG. 4*c*. Accordingly, the bar 50 is pivotable from the inactive position shown in FIG. 4*a*, to the active position shown in FIG. 4*b*. FIGS. 4*e* and 4*f* show a hook-and-loop secured strap for securing additional luggage/items to the rolling luggage.

Figure 5A:
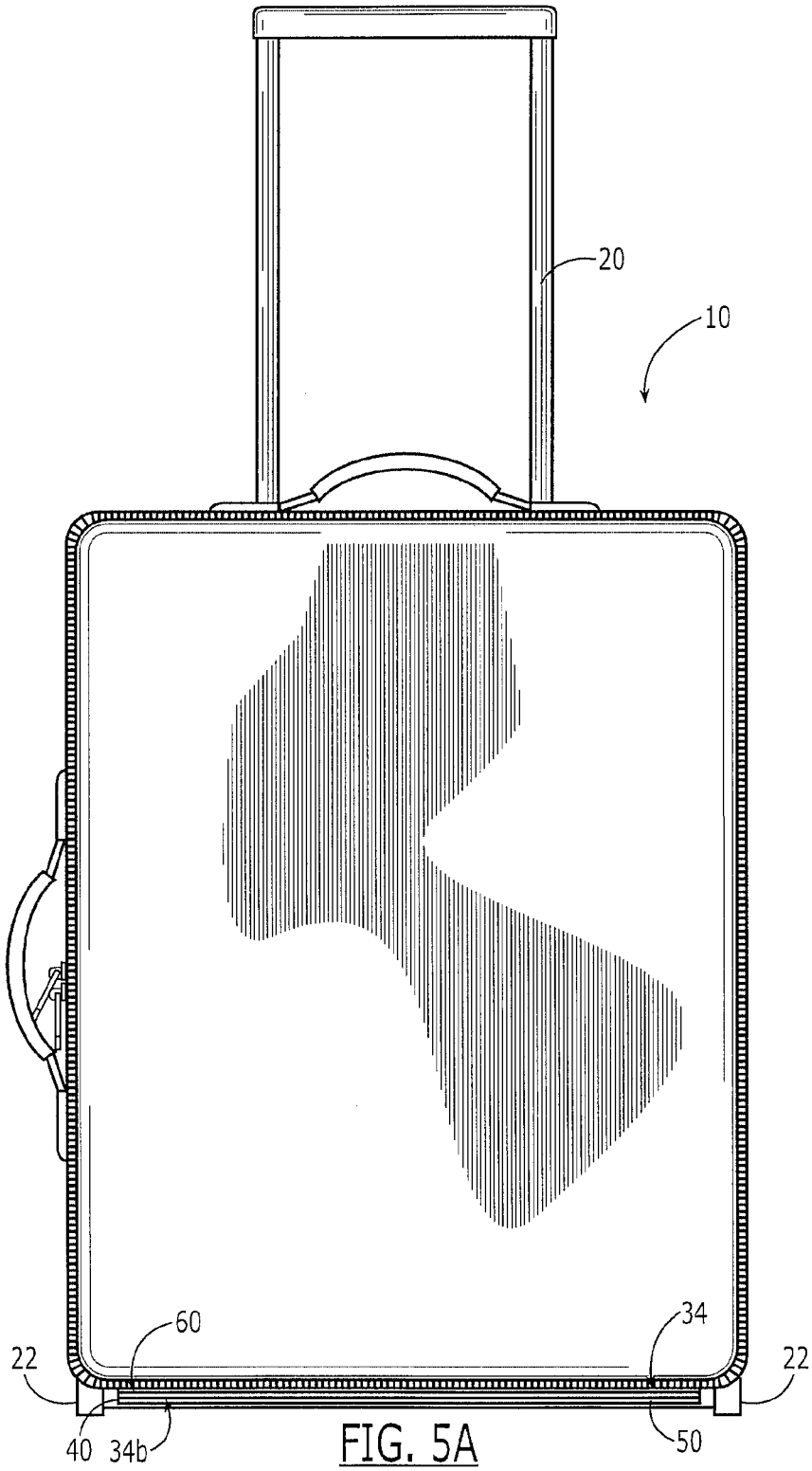
FIGS. 5*a*-5*d* illustrate an alternative embodiment of wheeled luggage including a sliding-plate style tongue.
Figure 5D:
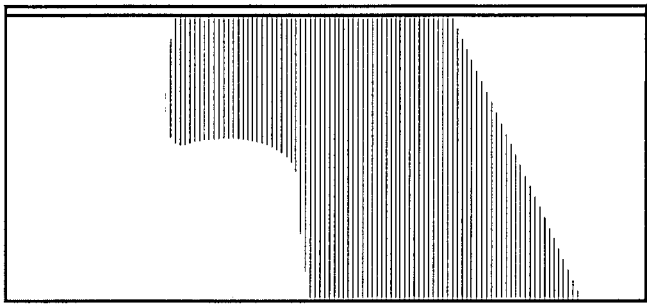
Figure 5B:
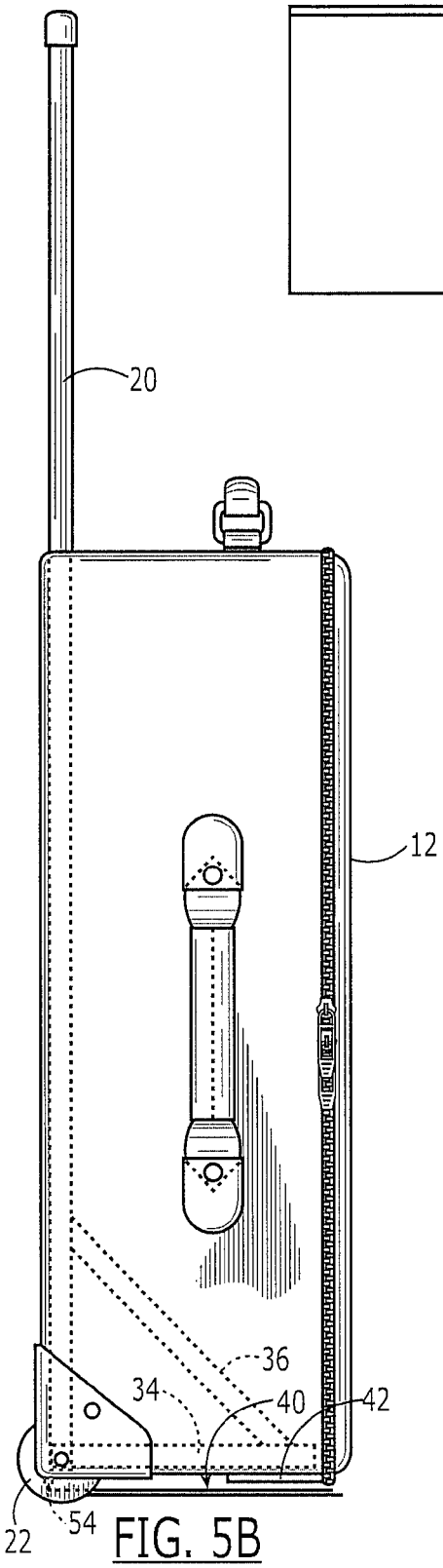
Figure 5C:
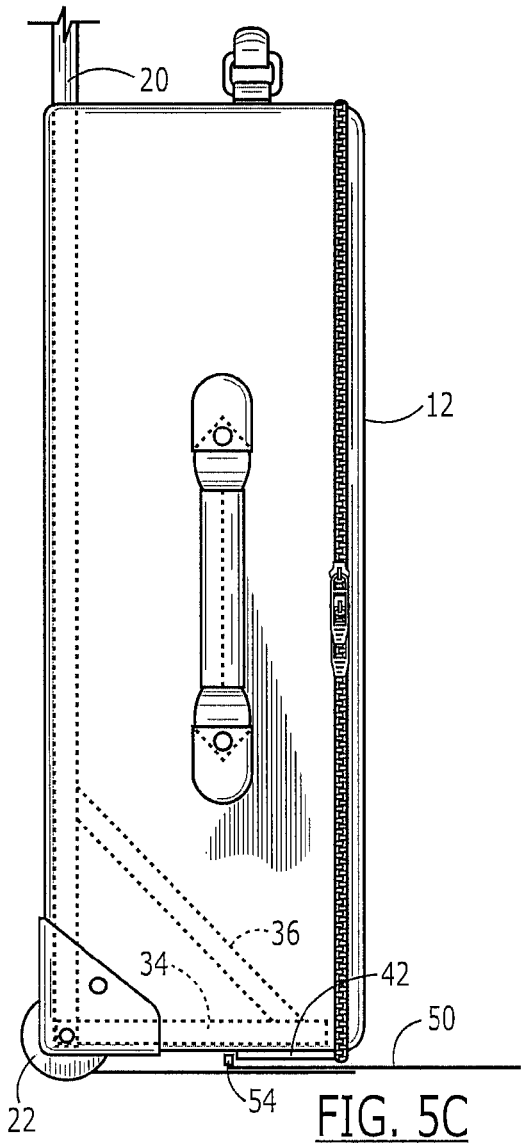

FIGS. 5*a*-5*d* illustrate an alternative embodiment including a sliding-plate style tongue 50. Referring now to FIGS. 5*a* and 5*b*, base member 34 includes spaced upper and lower portions 34*a* and 34*b* defining a pocket 40 beneath a bottom 28 of the body 12. The pocket 40 may be closed on all but one side, and stores tongue 50 when the tongue 50 is in the inactive position, as shown in FIGS. 5*a* and 5*b*. It will be noted that portions of the referenced structures are omitted and others are shown somewhat schematically, particularly in FIGS. 5*b* and 5*c*, for illustrative clarity. In this embodiment, the tongue 50 may be a substantially flat member, such as a plate, and may include a stop 54 extending out of the plane of the plate, as shown in FIGS. 5*b*, 5*c* and 5*d*. Stop 54 is positioned to interfere with a catch 42 in the pocket 40 that prevents the stop 54 from exiting the pocket 40 as the tongue 50 is moved to the active position, as shown in FIGS. 5*b* and 5*c*.

Figure 6C:
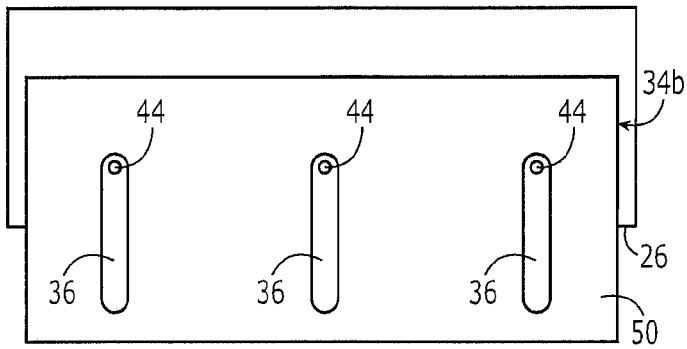
FIGS. 6*a*-6*e* illustrate another alternative embodiment of wheeled luggage including a sliding-plate style tongue.
Figure 6A:
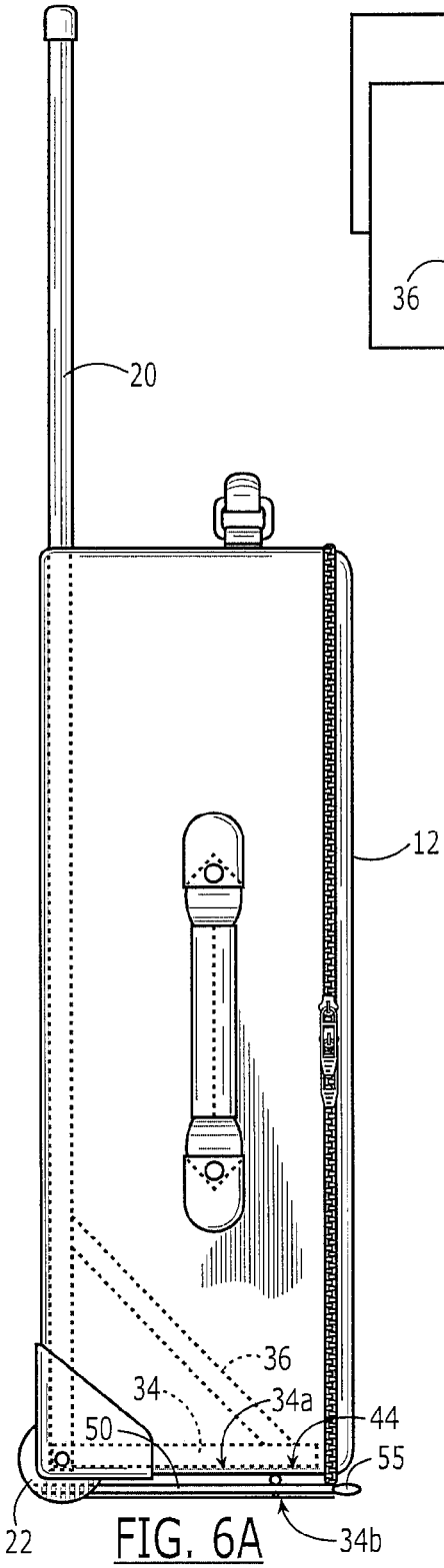
Figure 6B:
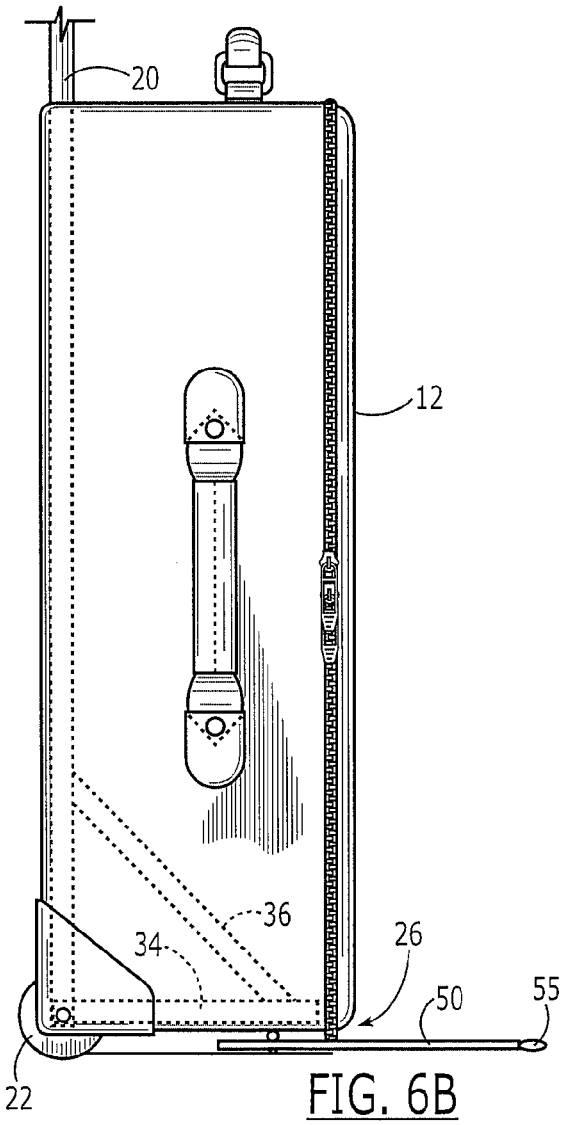
Figure 6D:
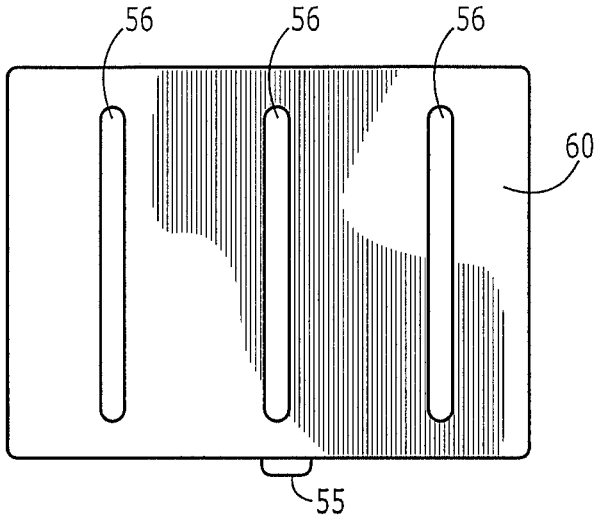
Figure 6E:
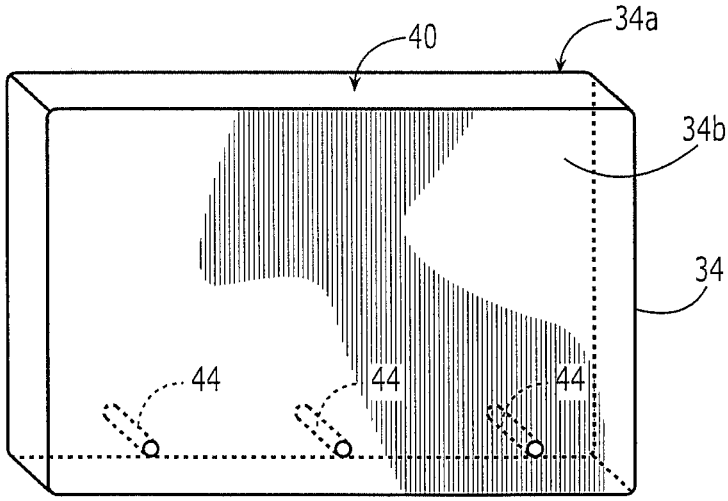

FIGS. 6*a*-6*e* illustrate an alternative embodiment including a sliding-plate style tongue similar to that shown in FIGS. 5*a*-5*d*. Thus, it will be noted that portions of the referenced structures are omitted and others are shown somewhat schematically, particularly in FIGS. 6*b* and 6*c*, for illustrative clarity. However, in the embodiment of FIGS. 6*a*-6*e*, at least one guide pin 44 is fixed between the upper and lower portions 34*a*, 34*b* of the base member 34 such that they extend across the height of the pocket 40, as shown in FIGS. 6*a* and 6*e* (only the base member 34 being shown in FIG. 6*e* for clarity). In this embodiment, the tongue 50 includes at least one elongated slot 56 dimensioned and positioned to receive a corresponding one of the guide pins 44, as best shown in FIGS. 6*c*, 6*d* and 6*e*. Accordingly, when the tongue 50 and base member 34 are assembled, guide pins 44 ride in slots 56 as the tongue 50 is moved from the inactive position, in which it resides in the pocket 40, to the active position, in which at least a portion of the tongue 50 extends out of the pocket, beyond the outer edge 26 of the body 12, as shown in FIG. 6*c*. Optionally, the tongue 50 may include a projection 55 that extends beyond outer edge 26 of the body 12, when the tongue 50 is in the inactive position, so that the projection 55 may be grasped manually to facilitate pulling of the tongue into the active position. A similar projection 55 may be included on any other embodiments discussed herein.

Figure 7A:
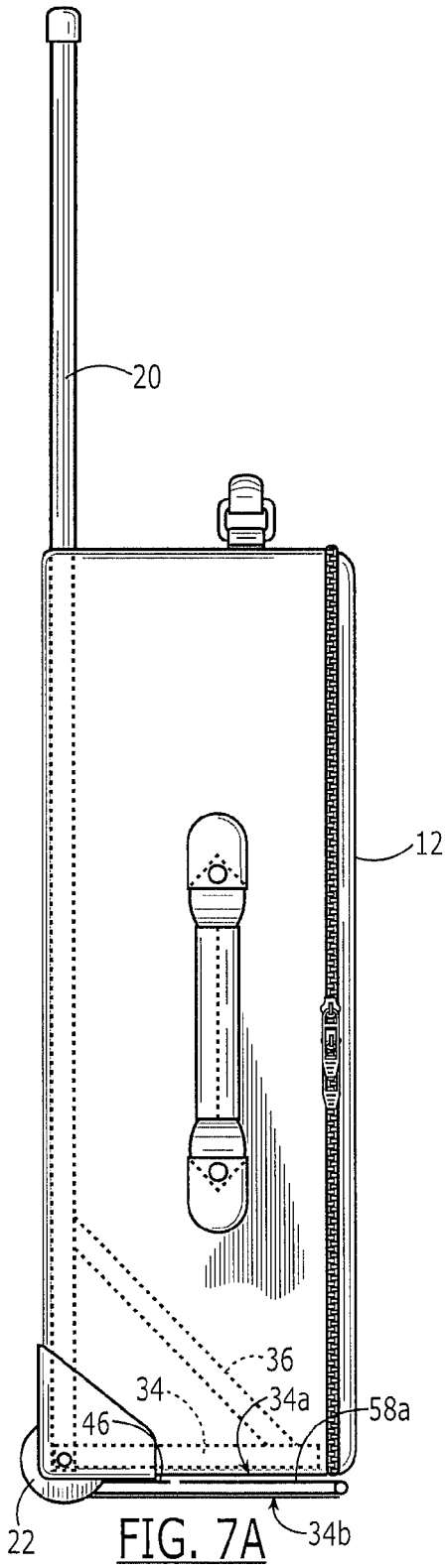
FIGS. 7*a*-7*f* illustrate an alternative embodiment of wheeled luggage including a sliding hinged-plate style tongue.
Figure 7B:
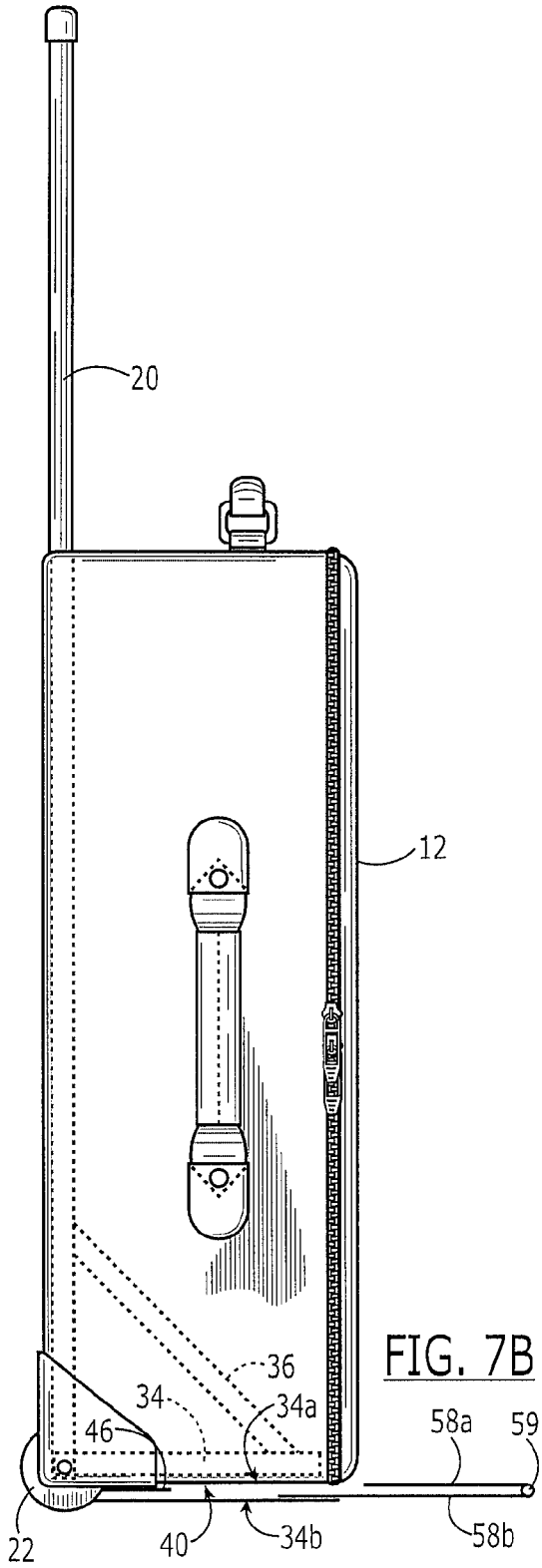
Figure 7C:
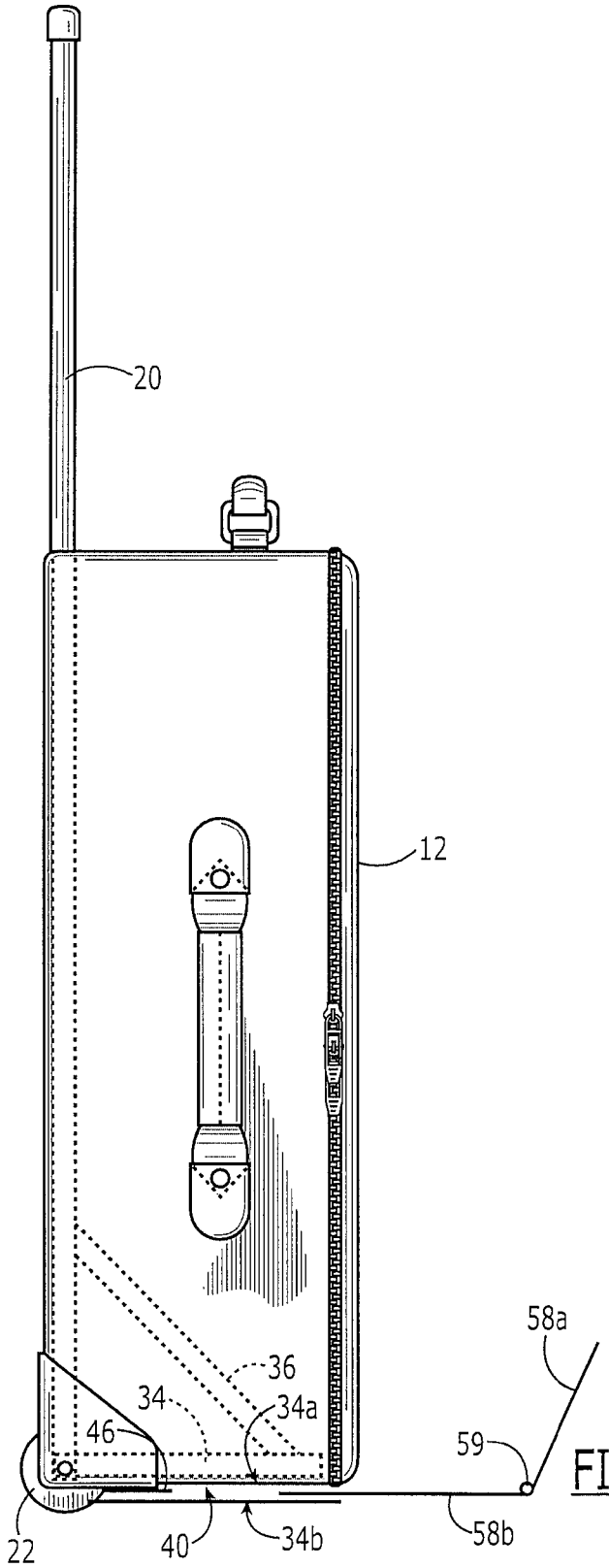
Figure 7D:
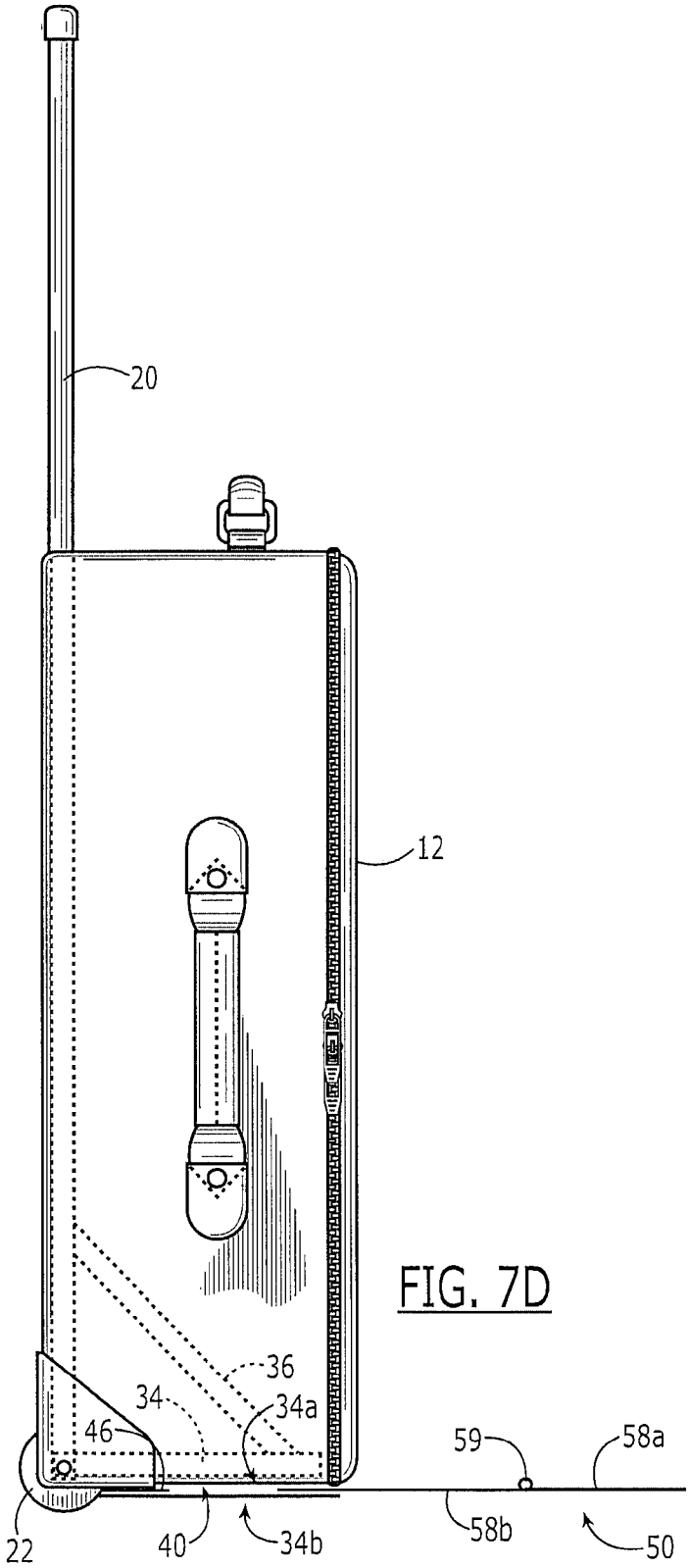
Figure 7E:
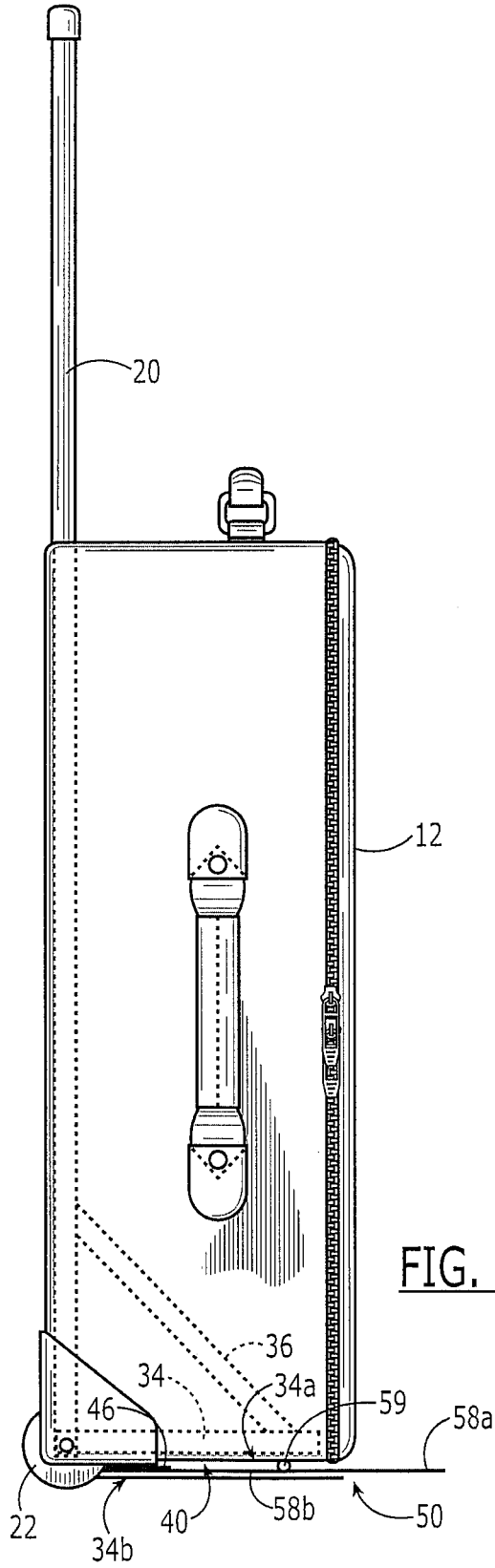
Figure 7F:
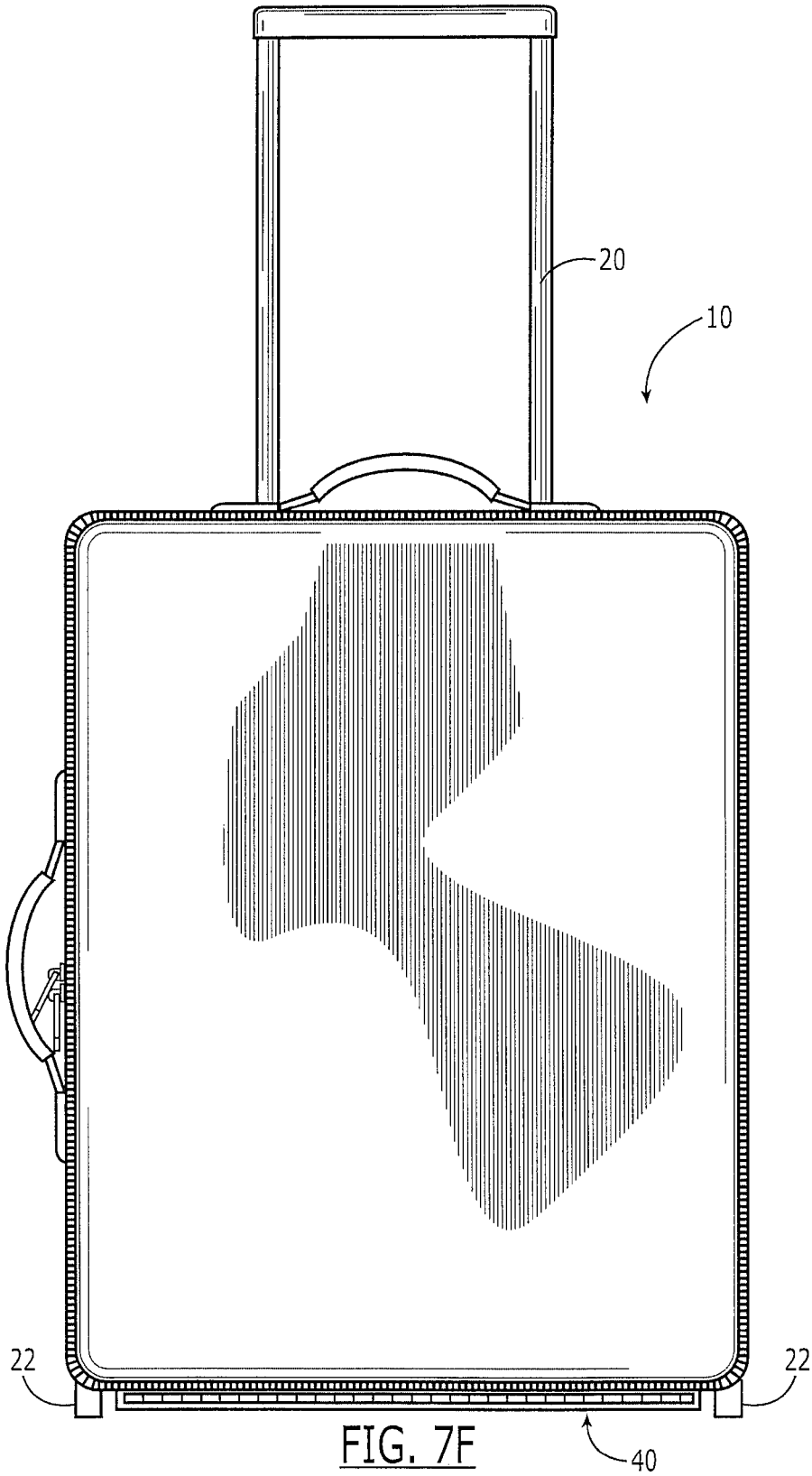
Figure 8A:
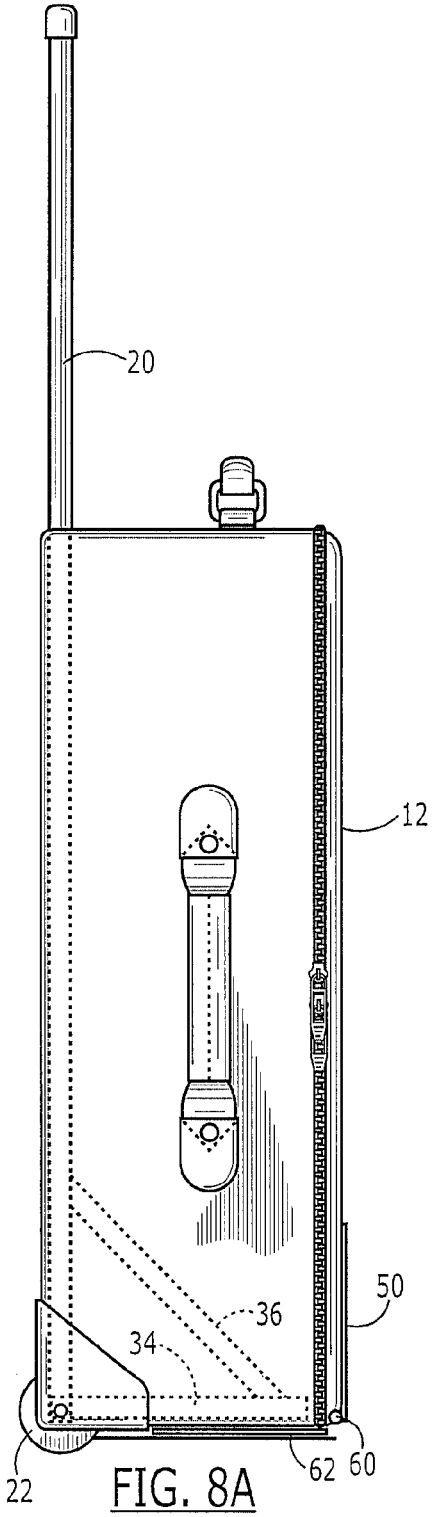
FIGS. 8*a*-8*d* illustrate another alternative embodiment of wheeled luggage including a sliding hinged-plate style tongue.
Figure 8B:
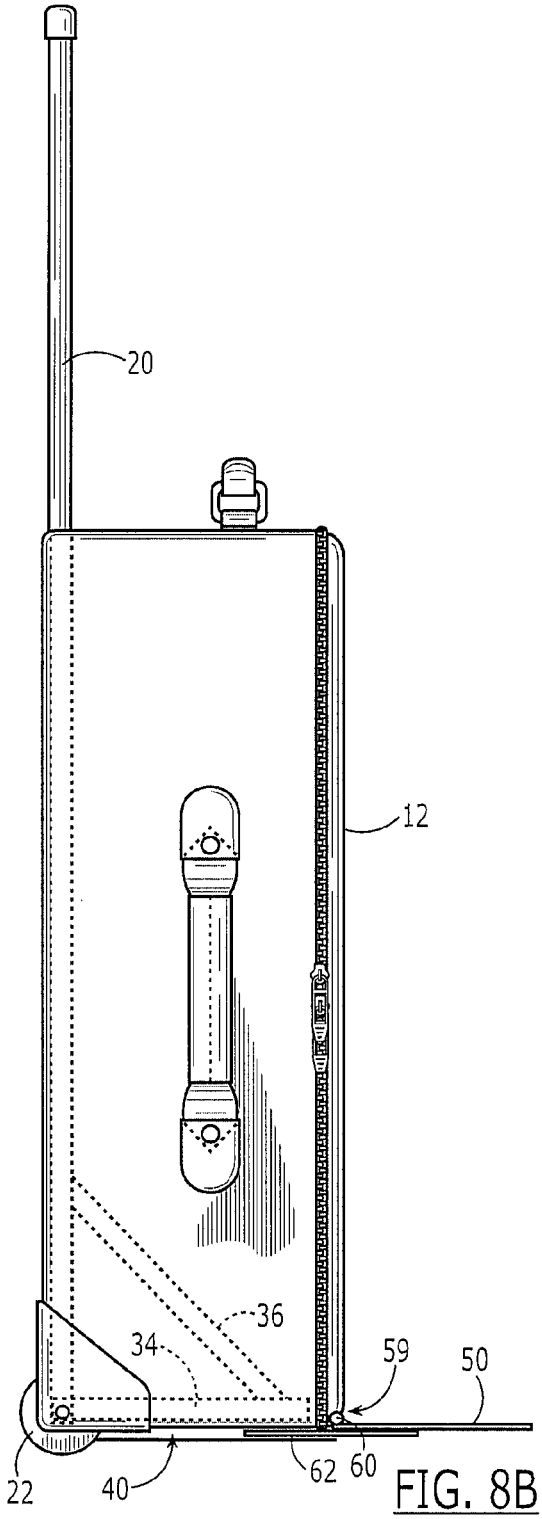
Figure 8C:
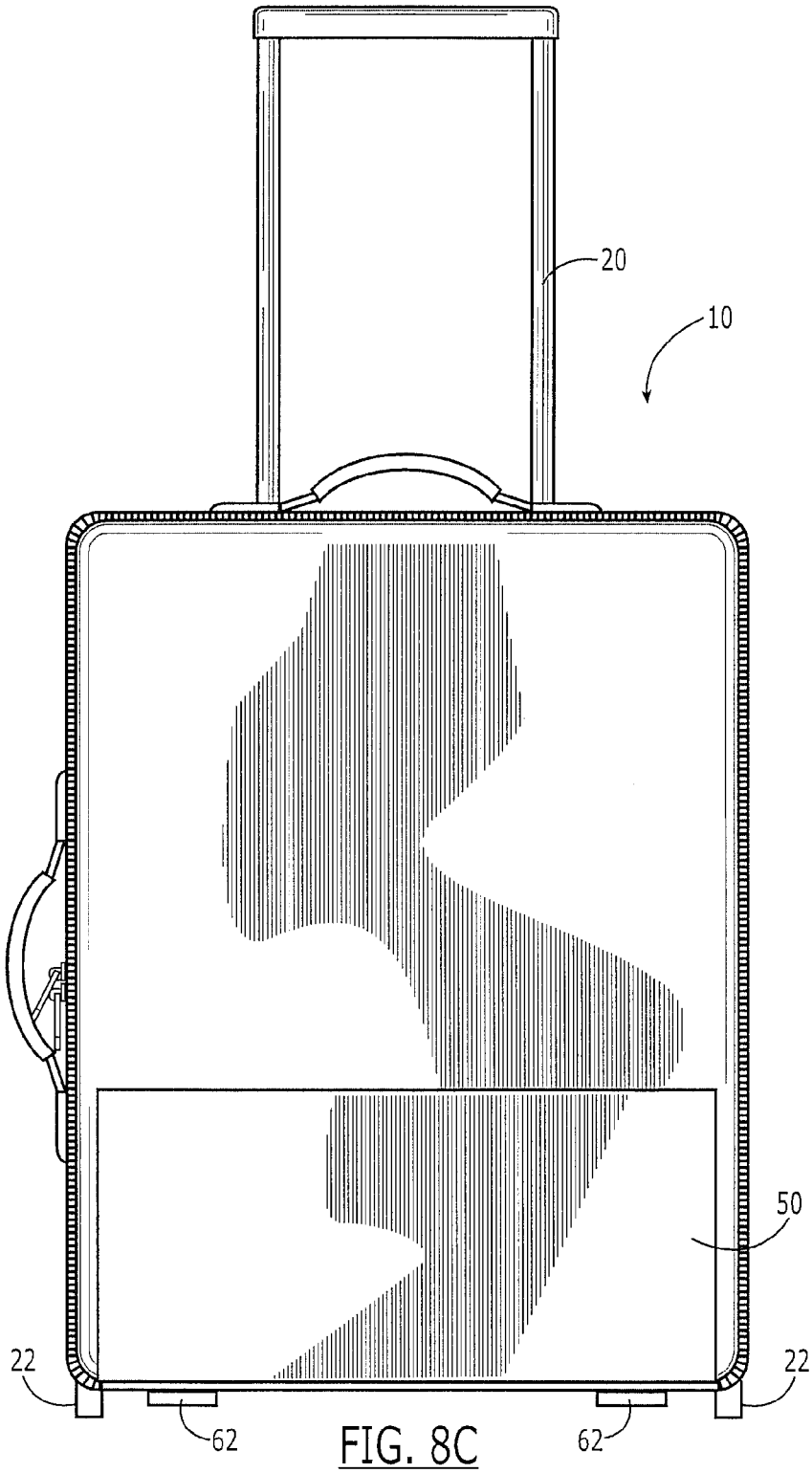
Figure 8D:
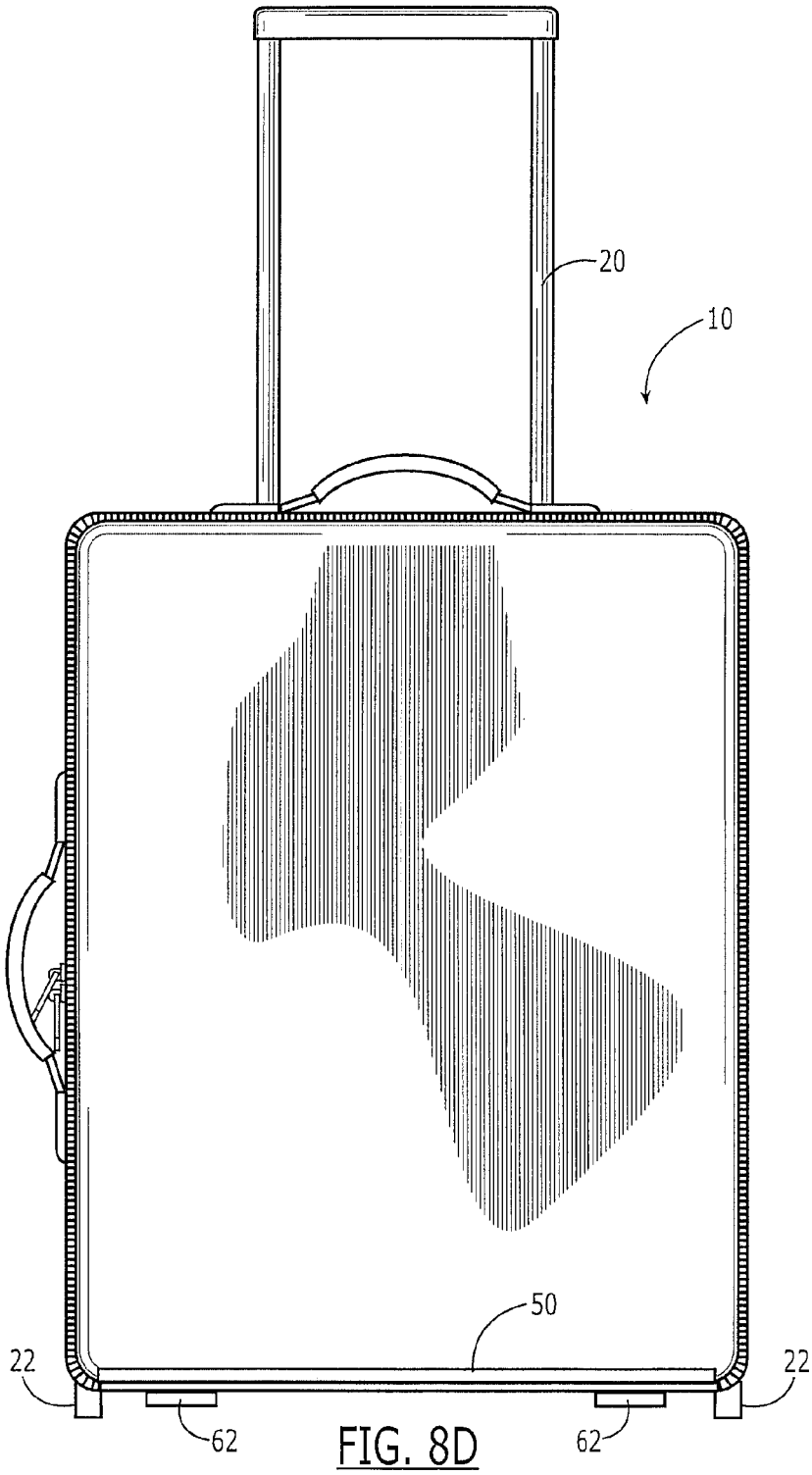

FIGS. 7*a*-7*f* illustrate an alternative embodiment including a sliding hinged-plate style tongue. It will be noted that portions of the referenced structures are omitted and others are shown somewhat schematically, particularly in FIGS. 7*a*-7*e*, for illustrative clarity. In this embodiment, the base member 34 defines an internal pocket 40 similar to that shown in FIG. 5*a*. In this embodiment, the tongue 50 is of a hinged-plate design, and thus includes a short leaf 58*a* and a long leaf 58*b* pivotably connected via a hinge pin 59. A stop 46 may be positioned towards a rear of the pocket 40 in position to interfere with a distal end of the short leaf 58*a*. Thus, the stop 46 limits travel of the tongue 50 into the pocket 40, while permitting the distal end of the long leaf 58*b* to pass by, as shown in FIG. 7*a*. In this embodiment, the tongue 50 is stored in the pocket 40 in a folded position, as shown in FIG. 7*a*. To fully extend the tongue, the folded tongue 50 is extended, at least partially, from the pocket 40, as shown in FIG. 7*b*, and the short leaf 58*a* is moved to an unfolded position in substantially planar alignment with the long leaf 58*b*, as shown in FIGS. 7*c* and 7*d*. The unfolded tongue 50 is then pushed back into the pocket 40 until the hinge pin 59/hinge is housed within the pocket 40, as shown in FIG. 7*e*. Thus, the tongue 50 is slidably retained in the pocket 40, and is slidable to a point at which the hinge is housed within the pocket, as shown in FIG. 7*e*.

In this manner, weight supported on the tongue 50 has a lesser tendency to pivot the hinge leaves 50*a*, 50*b*, and exerts primarily a shear force on the short leaf 50*a*.

FIGS. 8*a*-8*d* illustrate an alternative embodiment of the hinged-tongue in which the tongue 50 is hingedly mounted to the front of the luggage at hinge barrel 60, and a sliding support member 62 is slidably mounted beneath the plate 34 to be movable between a passive position and an active position. The support member 62 is slidably supported in the pocket 40. In this embodiment, the tongue 50 is considered to be in the inactive position in FIGS. 8*a* and 8*c*, and in the active position in FIGS. 8*b* and 8*d*. It will be noted that portions of the referenced structures are omitted and others are shown somewhat schematically, particularly in FIGS. 8*a* and 8*b*, for illustrative clarity. The structure of support member 62 may be similar to that shown in FIGS. 9*a*-9*e*.

Figure 9A:
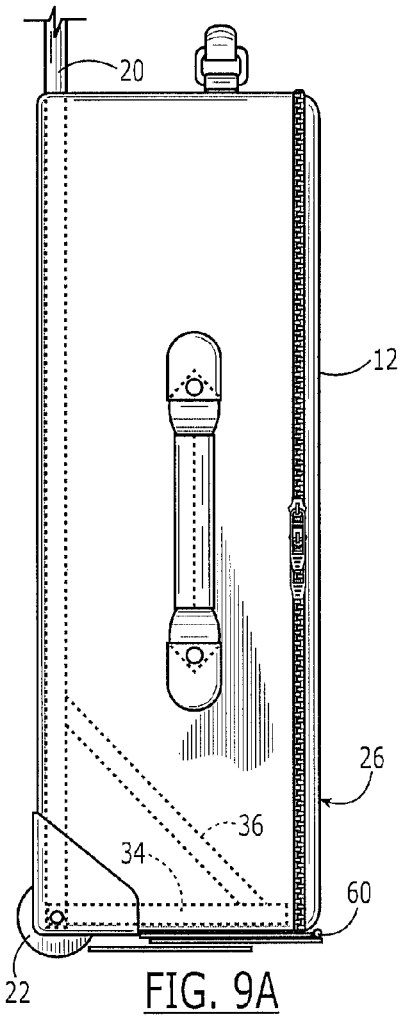
FIGS. 9*a*-9*e* illustrate another alternative embodiment of wheeled luggage including a hinged-plate with sliding-support style tongue.
Figure 9B:
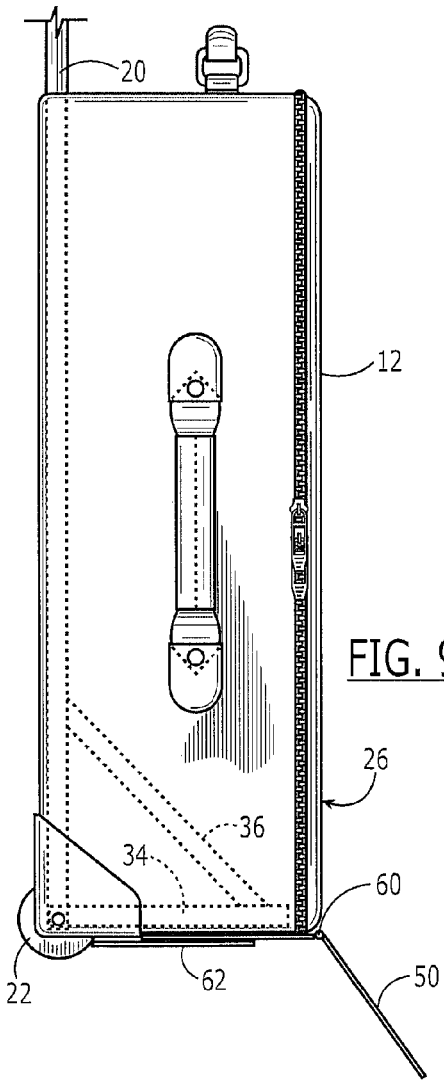
Figure 9C:
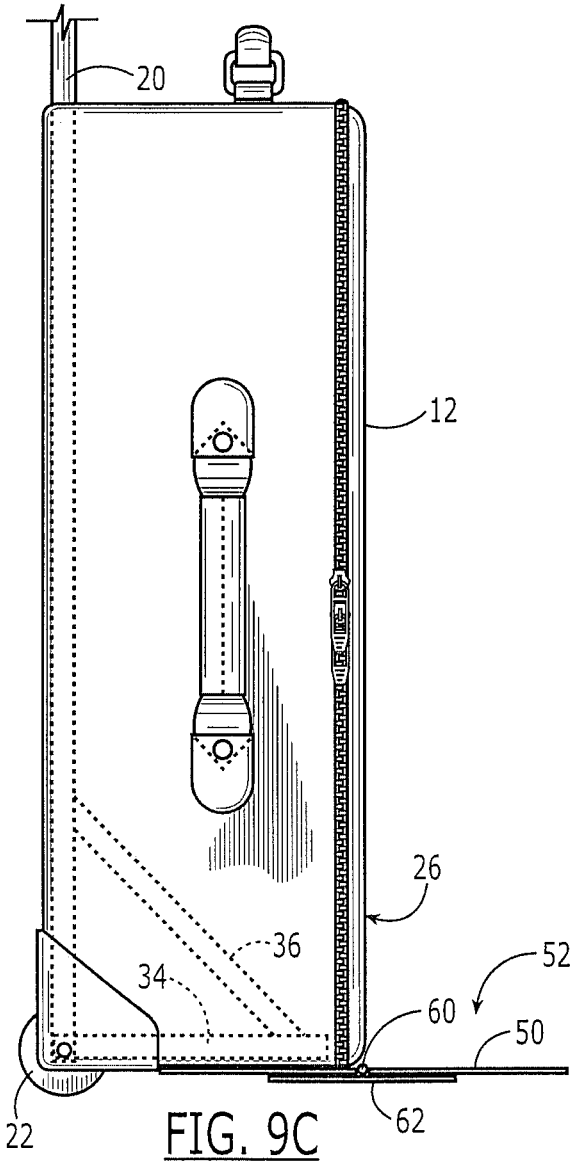
Figure 9D:
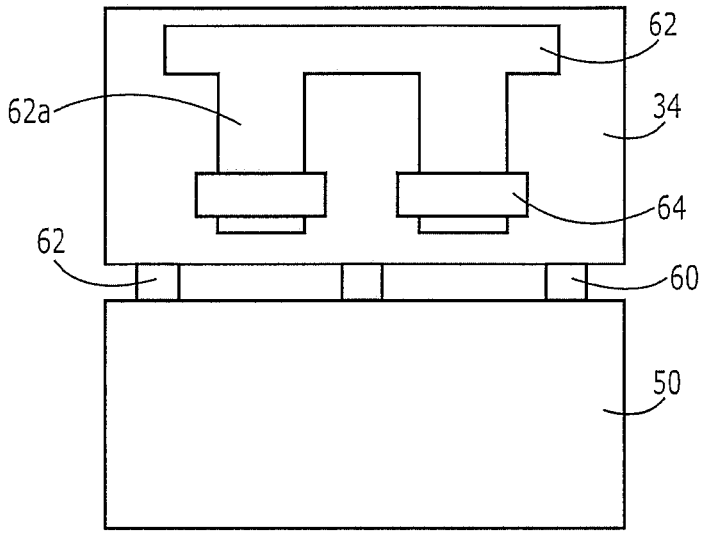
Figure 9E:
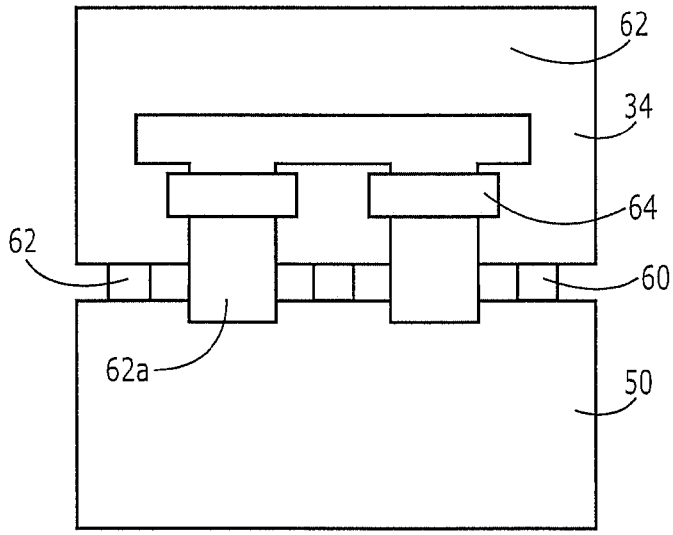

FIGS. 9*a*-9*e* illustrate another alternative embodiment including a hinged plate and a sliding support. It will be noted that portions of the referenced structures are omitted and others are shown somewhat schematically, particularly in FIGS. 9*a*-9*c*, for illustrative clarity. In this embodiment, the base member 34 need not form a pocket, but rather may be a plate. The tongue 50 is attached to the plate 34 by a hinge barrel 60 adjacent the outer edge 26 of the body 12. The tongue 50 is pivotable about pivot point 59 from the inactive position in which it is substantially parallel to the base member 34, as shown in FIG. 9*a*. The tongue 50 is pivotable to the active position in which it is substantially coplanar with base member 34, as shown in FIGS. 9*b* and 9*c*. A support member 62 is slidably supported on the base member 34 by guides 64 that capture the support member, as best shown in FIGS. 9*d* and 9*e*. The support member 62 is slidable between a passive position and an active position. In the passive position, the support member 62 does not interfere with pivoting of the tongue, as shown in FIG. 9*d*. Preferably, the support member 62 resides between the tongue 50 and the base member 34 when the tongue 50 is in the inactive position, as shown in FIG. 9*a*. In the active position, a portion 62*a* of the support member 62 extends beyond hinge barrel 60 in underlying relationship to the tongue 50, as shown in FIG. 9*e*. Thus, the support member 62 limits pivoting of the tongue 50 toward the inactive position, and thus effectively locks the tongue into an operable position, as shown in FIG. 9*e*. It will be appreciated that hinge barrel 60 and hinge pin 59 may be of a segmented design to permit a portion 62*a* of the support member 62 to pass by it in moving toward the active position. FIGS. 9*d* and 9*e* show a segmented hinge pin 59 and barrel 60 having three segments. Optionally, the portion 62*a* of the support member 62 resembles an I-beam in cross-section, to provide rigid support.

Figure 10A:
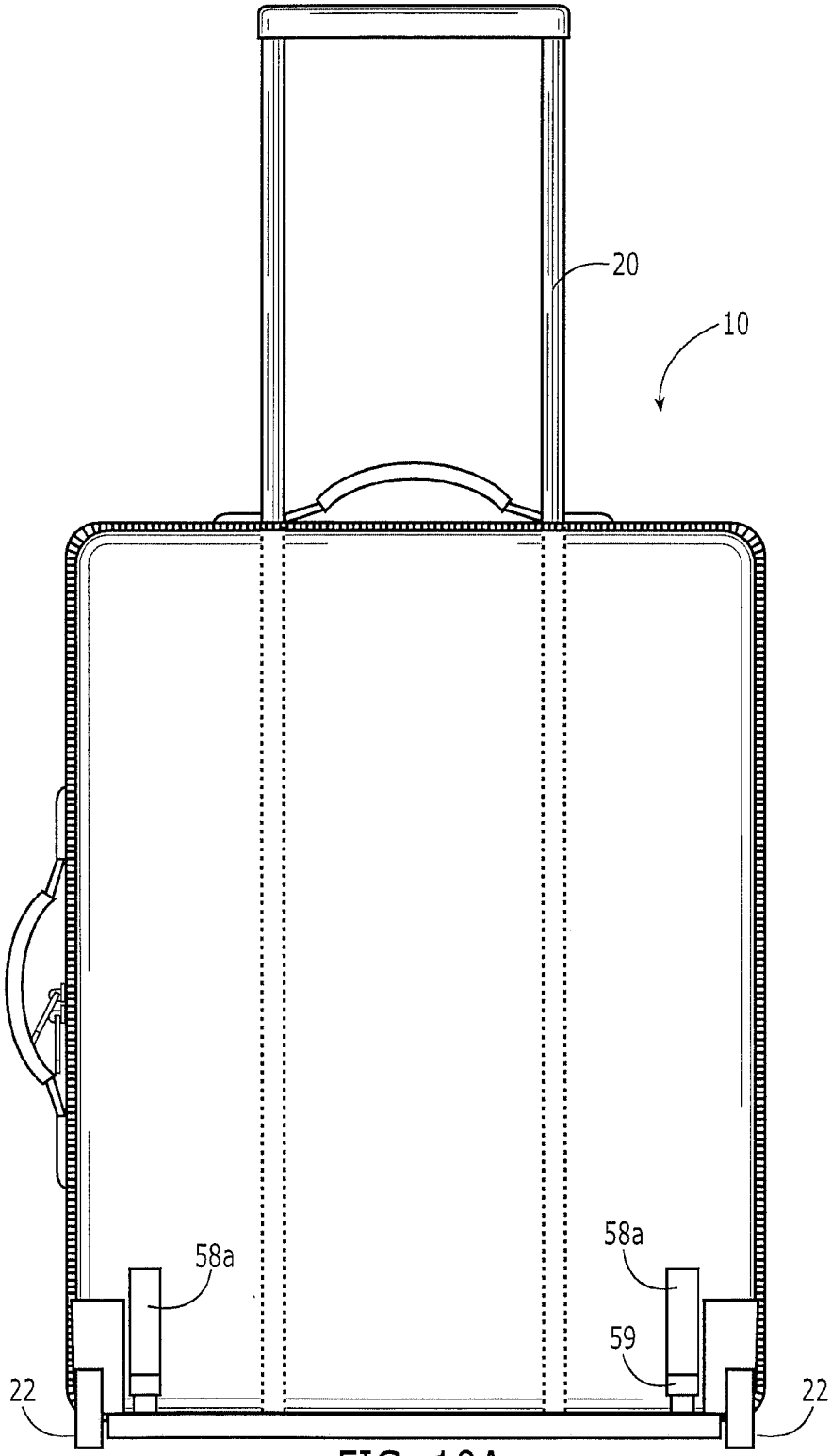
FIGS. 10*a*-10*d* illustrate another alternative embodiment of wheeled luggage including a sliding hinged-plate style tongue.
Figure 10B:
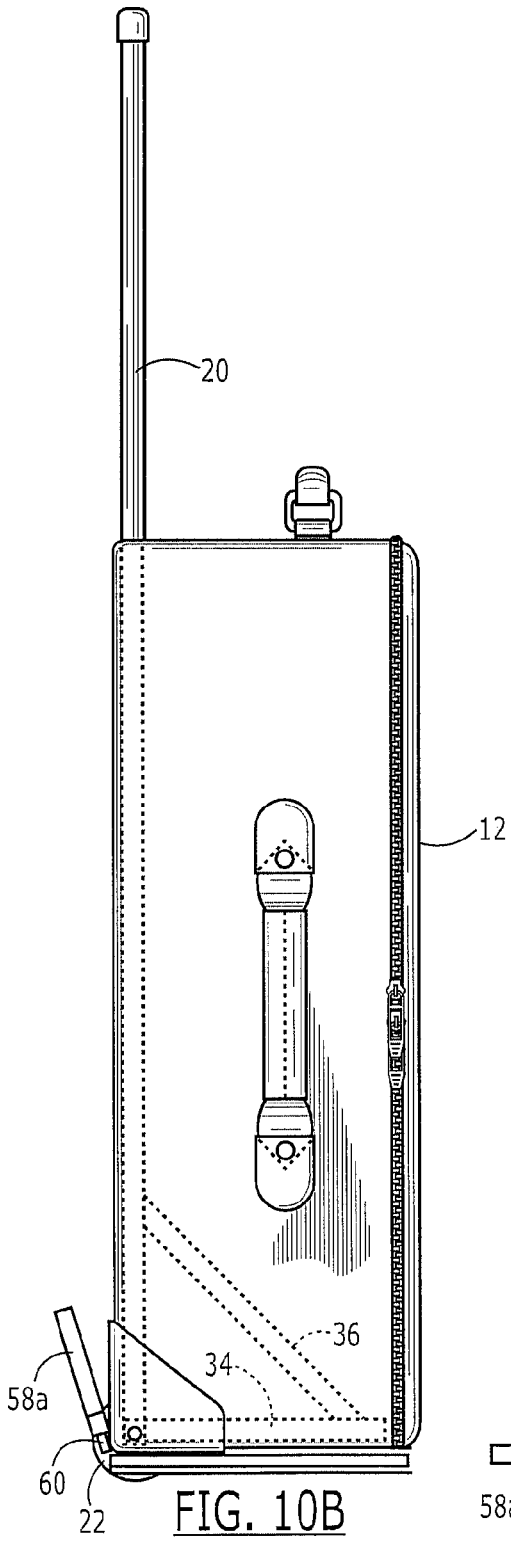
Figure 10C:
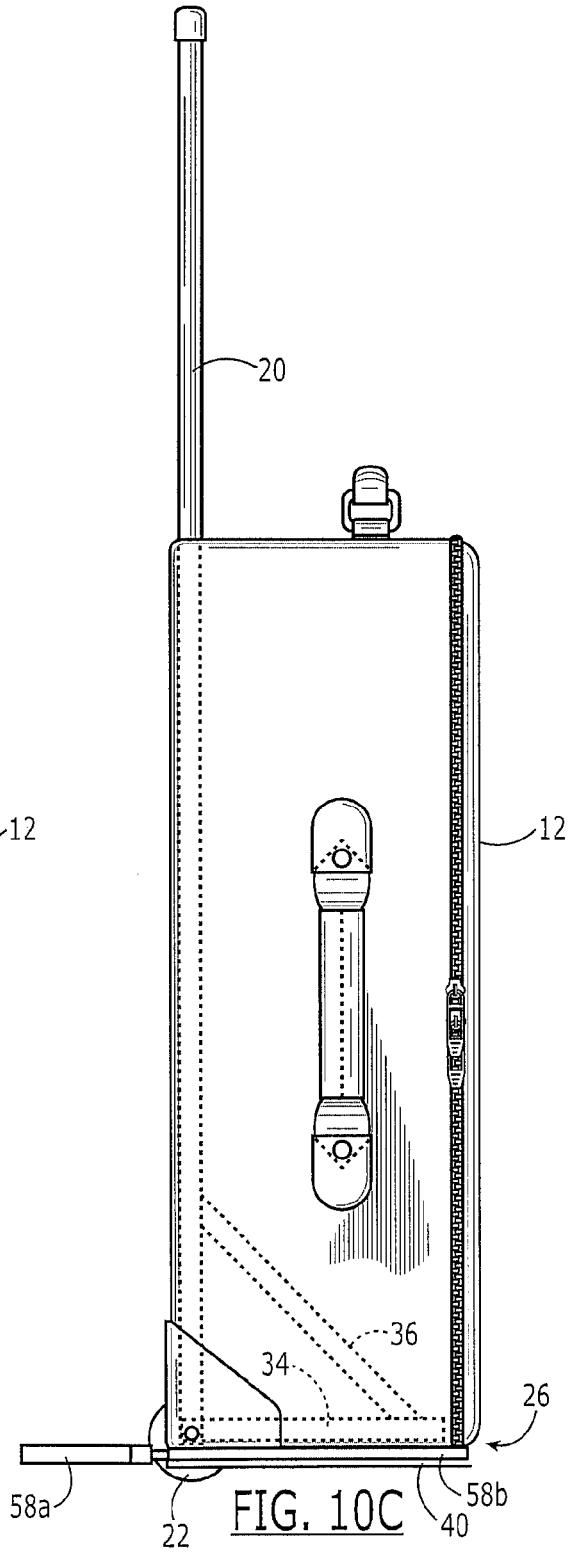
Figure 10D:
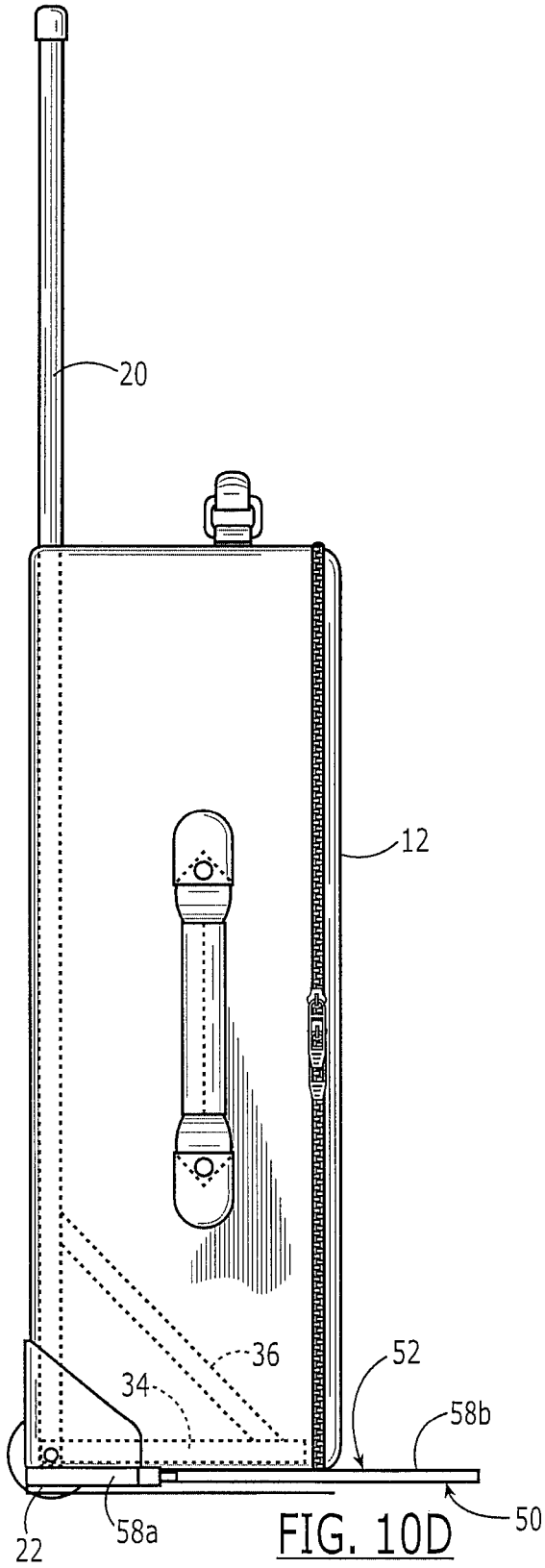

FIGS. 10*a*-10*d* illustrate another alternative embodiment of wheeled luggage including a sliding-hinged plate style tongue. In this embodiment, the base member 34 forms a pocket 40 that is open toward both the front and rear of the body 12. The tongue 50 includes at least one pivotable leaf 58*a* connected to another leaf 58*b* by a hinge barrel 60 housing a hinge pin 59. In this embodiment, leaves 58*a* are normally in a substantially upright position when the tongue is in the inactive position, as shown in FIG. 10*a*. To move the tongue 50 into the active position, the pivotable leaves 58*a* are pivoted downwardly into a position that is substantially coplanar with the other leaf 58*b*, as shown in FIGS. 10*b* and 10*c*. The tongue 50 is then pushed forward from behind to cause the tongue 50 to ride within the pocket 40 of the base member 34, and to extend a portion of the tongue 50 beyond the outer edge 26 of the body 12, as shown in FIG. 10*d*. It should be noted that in this embodiment, the hinge barrel 60 remains trapped within the pocket 40 when the tongue 50 is in the active position, as shown in FIG. 10*d*, with the weight carried by the extended portion of the tongue 50 exerting primarily a shear force on leaf 58*b*.

Figure 11A:
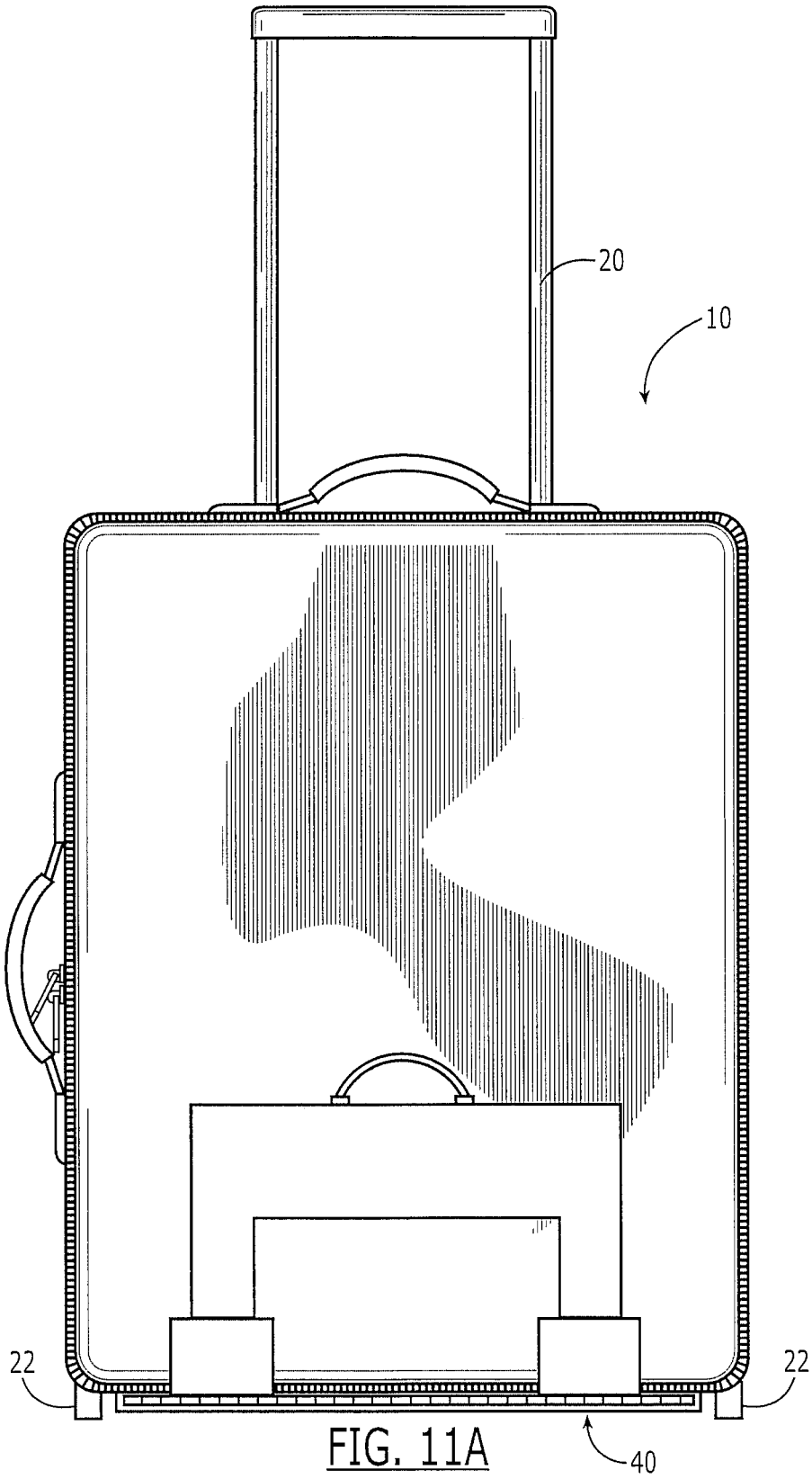
FIGS. 11*a*-11*e* illustrate an alternative embodiment of wheeled luggage that includes a removable tongue.
Figure 11B:
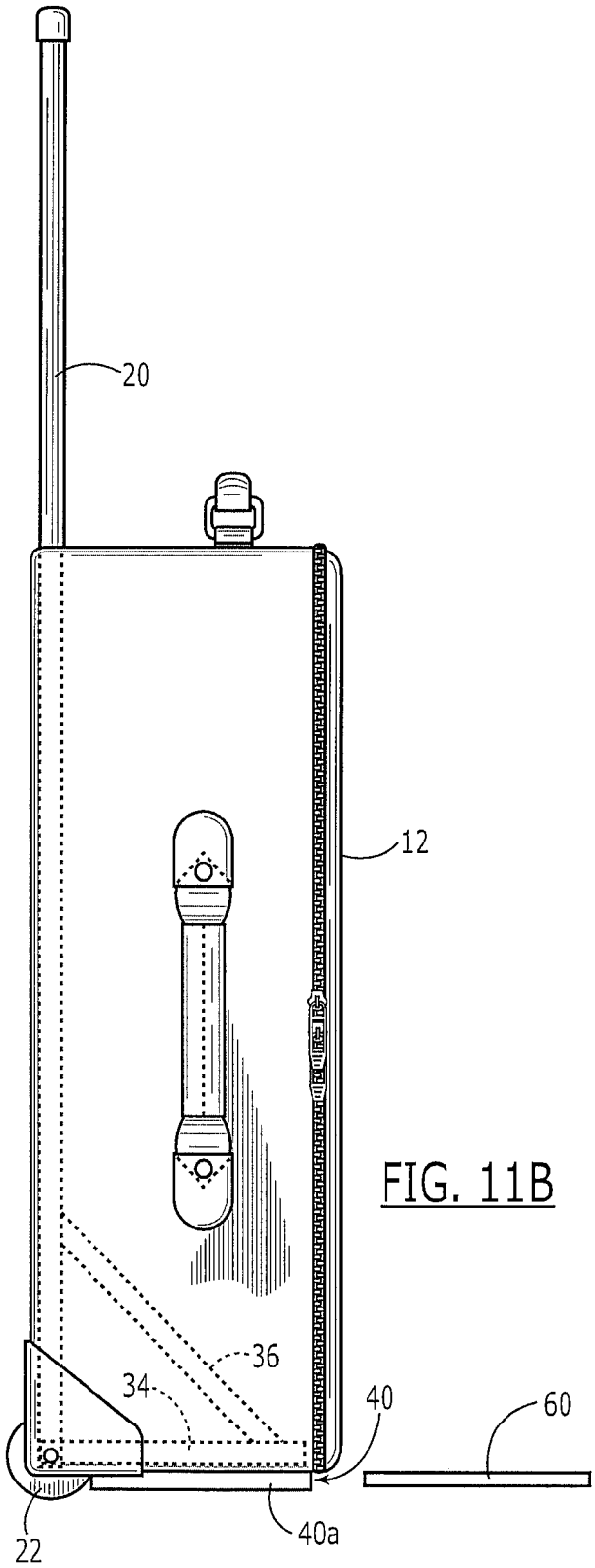
Figure 11D:
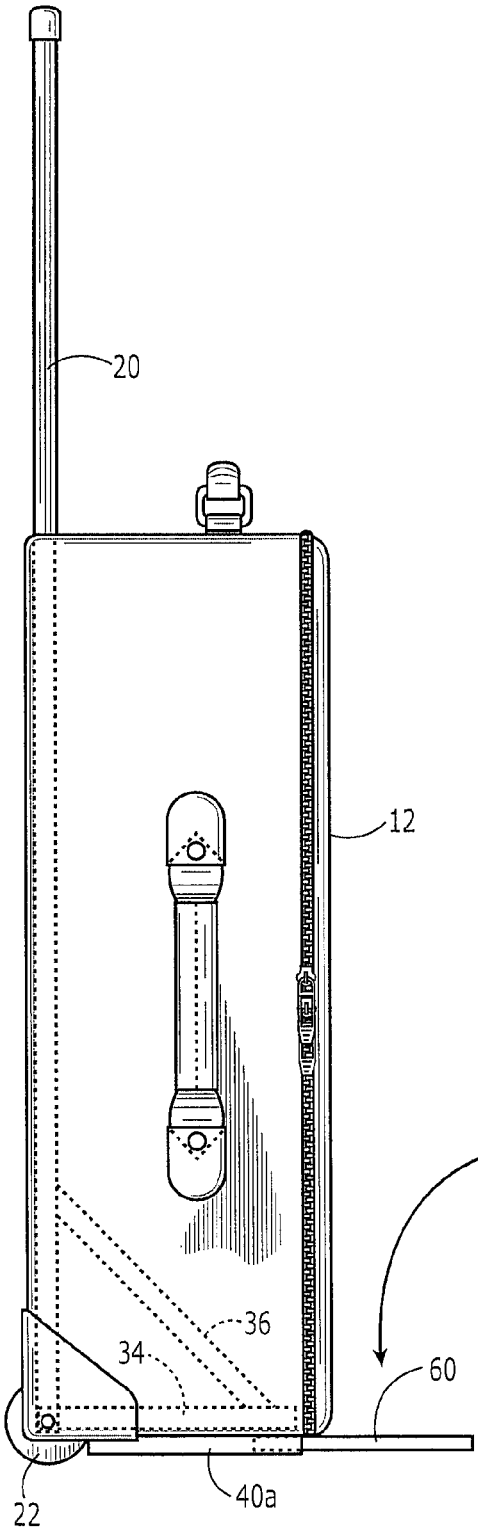
Figure 11D:
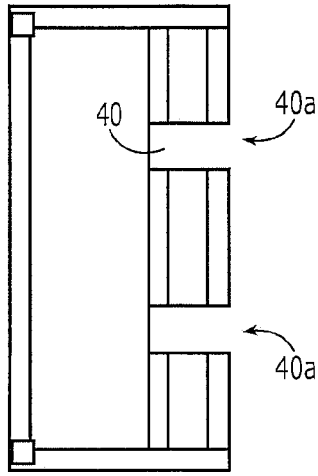
Figure 11E:
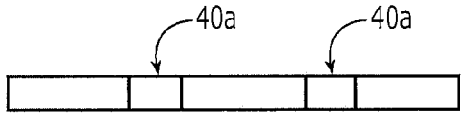
Figure 11C:
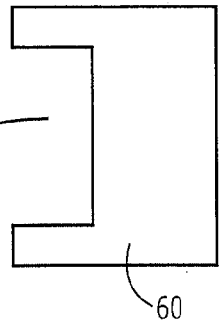
Figure 12A:
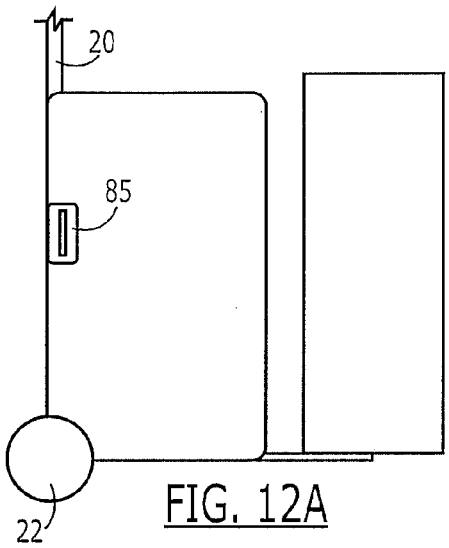
FIGS. 12*a*-12*d* illustrate an exemplary securing strap mechanism.
Figure 12B:
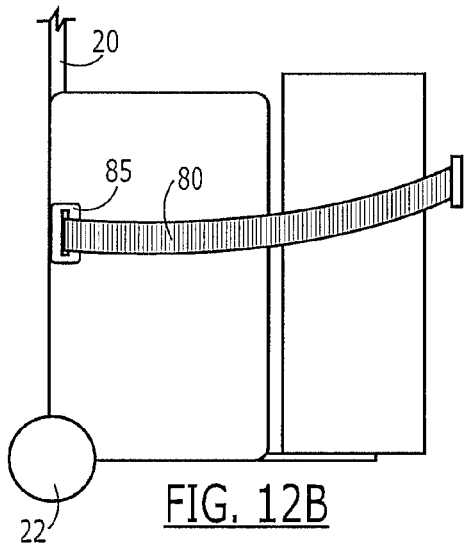
Figure 12C:
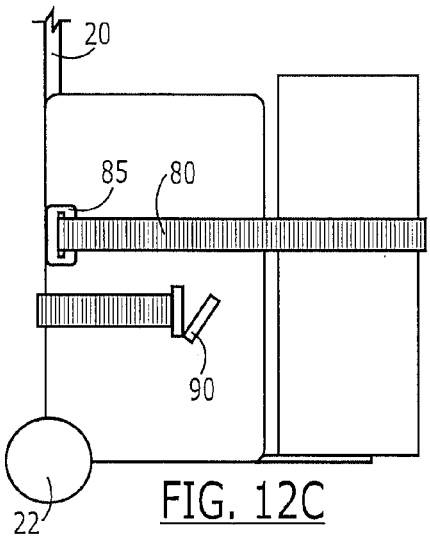
Figure 12D:
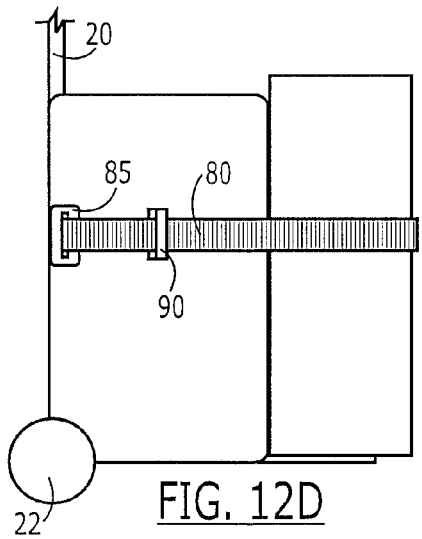

FIGS. 11*a*-11*e* illustrate an alternative embodiment that includes a removable tongue 50. In this embodiment, the tongue 50 is removably attachable to the base member 34. For example, the tongue may be removed and stored, either inside the body 12 or outside the body 12 by a combination of one or more clips, pockets, etc. In the exemplary embodiment of FIG. 11*a*, the tongue may be stored by a clip 70 that holds in place the tongue 50 when supported by pockets 72. The tongue 50 is removable from its inactive (stored) location and may be inserted into portions of the base member 34 dimensioned to receive leg portions 53 of the tongue. For example, the pocket 40 may define a socket 40*a* for receiving each leg portions 53, as best shown in FIGS. 11*d* and 11*e*. For example, both the socket and the leg may be square, or otherwise shaped in cross-section to prevent rotation of the leg within the socket.

Such wheeled luggage is capable of carrying many different types of additional luggage, such as suitcases, golf clubs, a briefcase, a laptop case, a backpack purse, duty-free shopping items, etc. Due to the variety in size, shape, and weight of such items, it may be particularly useful to include in any of the embodiments discussed above, a strap 80 for securing the additional luggage 100 to the wheeled luggage 10. The strap 80 may be provided as a simple bungee cord, a hook-and-loop fastener securable strap, string, a belt with adjustable buckle, etc., having at least one end attached to the body 12 of the wheeled luggage 10.

In one embodiment, the strap 80 is fixed to a portion of the body 12 and includes a fastener at least one end. For example, hook and/or loop fastener material may be included on the strap 80 to allow the strap to be looped through a handle or other portion of additional luggage 100, and then be secured to the strap itself, or a suitable part of the body 12, etc., as shown in FIGS. 4*e* and 4*f*.

Figure 14A:
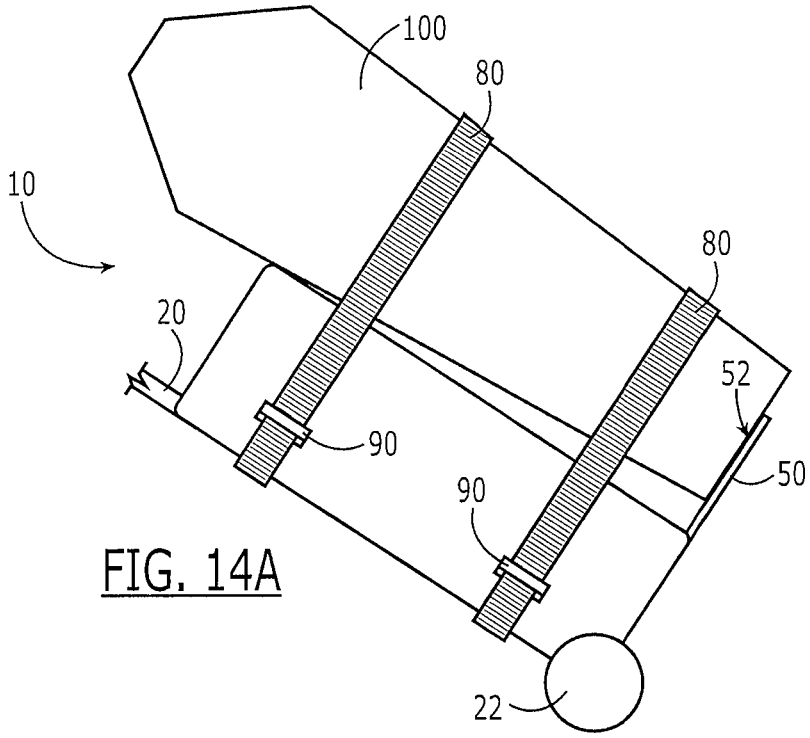
FIGS. 14*a* and 14*b* illustrate use of the straps to secure additional luggage.

In a preferred embodiment, the strap 80 is provided as part of a self-winding mechanism 85 capable of extending and retracting the strap 80, as shown in FIGS. 12*a*-12*d*. The self-winding mechanism 85 is attached to the body in a position to allow the strap to be extended around the additional luggage 100, and to be attached at its distal end to the body 12 to secure the additional luggage 100 to the body 12. Various such self-winding/retraction mechanisms are well known in the art, and thus are not discussed in detail herein. Any suitable self-winding/retraction mechanism may be used for this purpose. Optionally, an adjustable securing strap/mechanism is provided toward each of the upper and lower ends of the body 12, as shown in FIG. 14*a*.

Figure 13A:
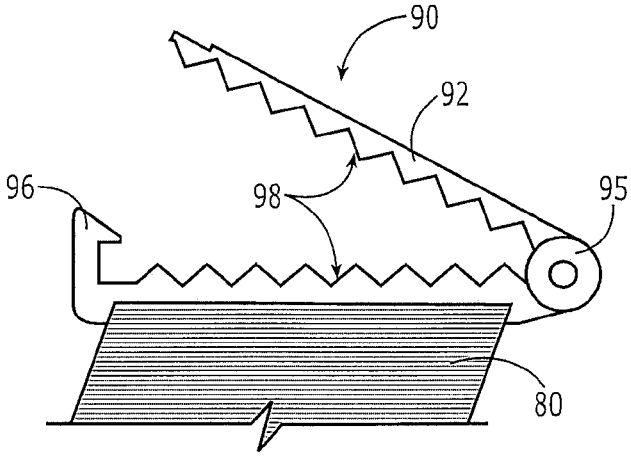
FIGS. 13*a*-13*c* illustrate an exemplary clip for securing the strap of FIGS. 12*a*-12*d;*
Figure 13B:
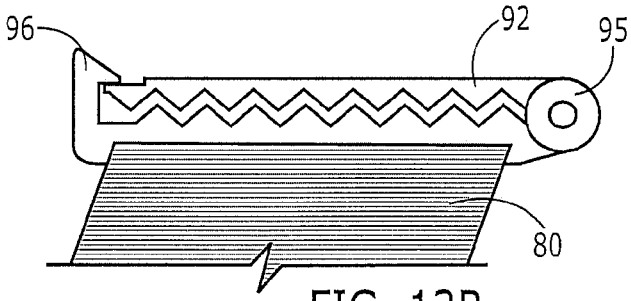
Figure 13C:
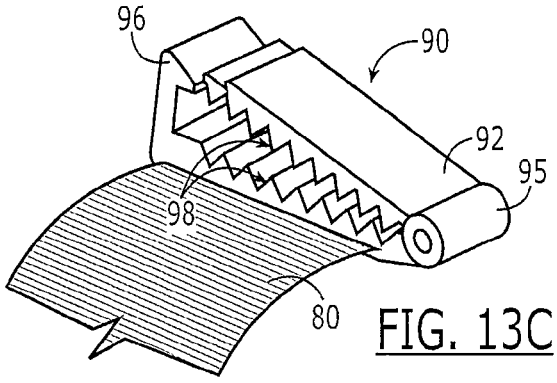

FIGS. 13*a*-13*c* illustrate an exemplary clip for securing the strap of FIGS. 12*a*-12*d*. This exemplary clip 90 is optional. The clip 90 may include a lower jaw 92 joined to the strap 80, an upper jaw 94 pivotable about a hinge 95, and a resilient catch 96 capable of capturing the upper jaw 94 and retaining it in engagement with the lower jaw 92, as shown in FIG. 13*b*. Optionally, the upper and lower jaws 94, 92 include mating teeth 98 for securely grasping the strap 80.

Figure 14B:
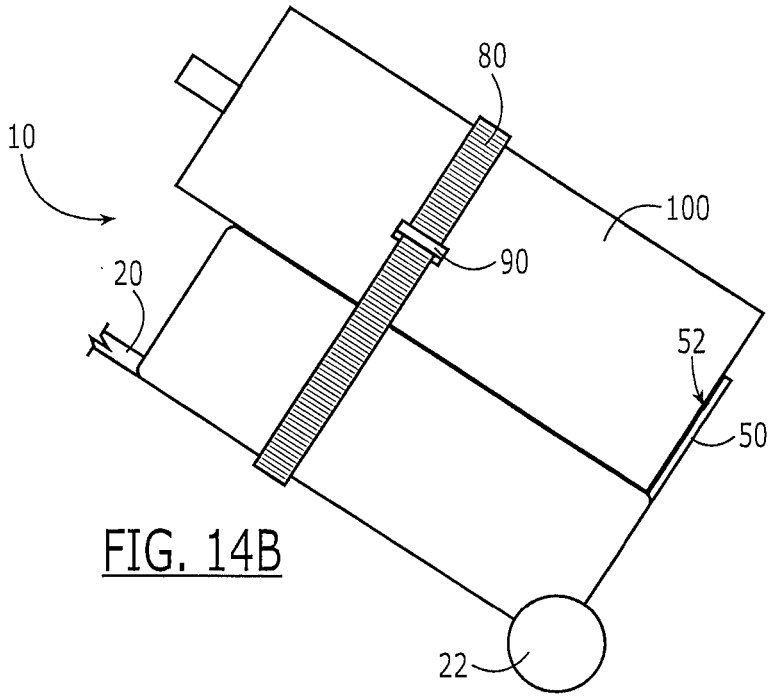

In use, the wheeled luggage 10 of the present invention may be used by moving the tongue 50 from the inactive position to the active position as described above with respect to the various embodiments. Additional luggage 100 may then be placed on the tongue 50 while the wheeled luggage 10 stands in a substantially upright position, with a portion of the additional luggage 100 resting on the support surface 52 of the tongue 50, as shown in FIGS. 14*a* and 14*b*. The securing strap 80 may be extended from any retraction mechanism 85, looped around the additional luggage 100, and then fastened to the body, strap, etc., as shown in FIGS. 14*a* and 14*b*. The handle 20 may be extended in a conventional manner. The handle may then be used to tilt the wheeled luggage 10 (and concomitantly the additional luggage 100 supported on the tongue 50), onto the wheels 22, at which point the wheeled luggage 10, and any additional luggage 100 supported on the tongue 50, may be transported in tandem by pulling on the handle 20. This allows the wheeled luggage 10 to be effectively used as a hand truck for transporting the additional luggage.

Figure 16A:
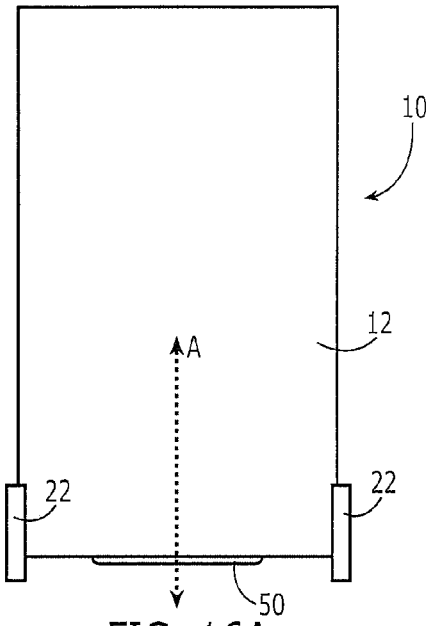
FIGS. 16*a*-16*d* illustrate another alternative embodiment of wheeled luggage that includes a rotatable tongue.
Figure 16B:
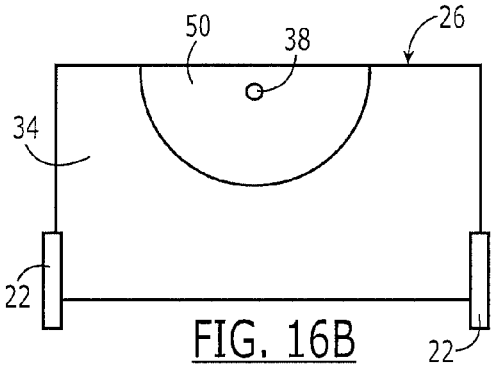
Figure 16C:
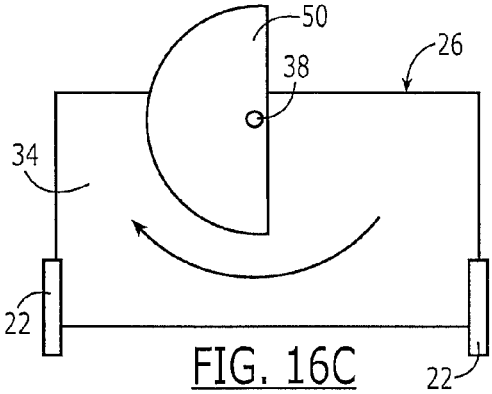
Figure 16D:
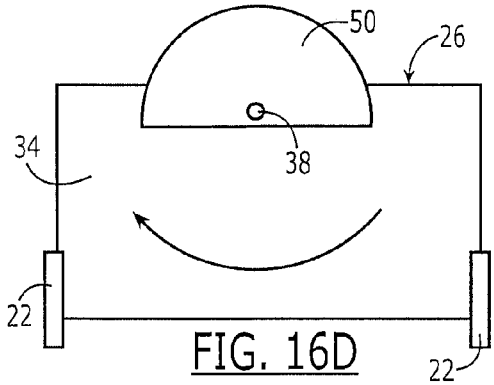

By way of further example, FIGS. 16*a*-16*d* illustrate another alternative embodiment of wheeled luggage that includes a rotatable tongue 50. The tongue is supported on a bushing 38 supported on the base member 34, and may be a rigid, plate-like bar to be rotatable about an axis A. The tongue may be semicircular in shape, or have any other desired shape permitting it to be moved between an inactive position, as in FIG. 16*b*, to an active position, as shown in FIG. 16*d*.

Figure 17A:
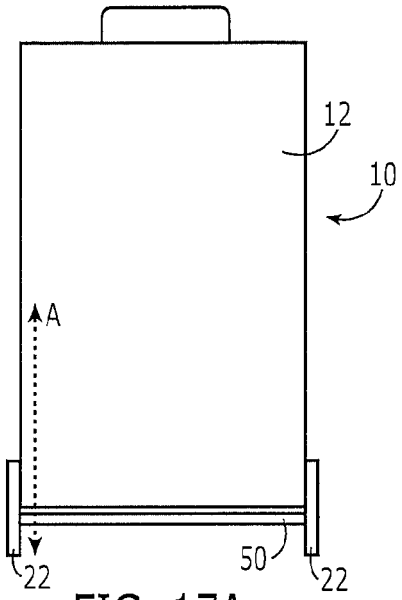
FIGS. 17*a*-17*e* illustrate another alternative embodiment of wheeled luggage that includes a pivotable tongue.
Figure 17B:
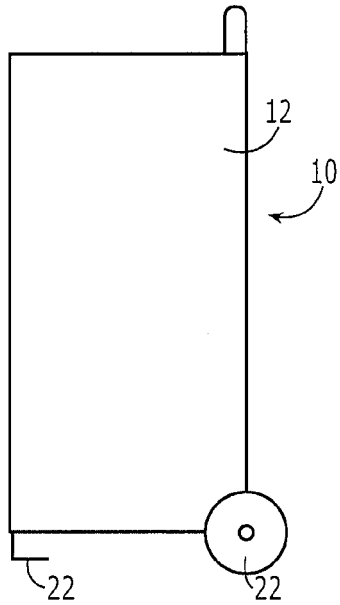
Figure 17C:
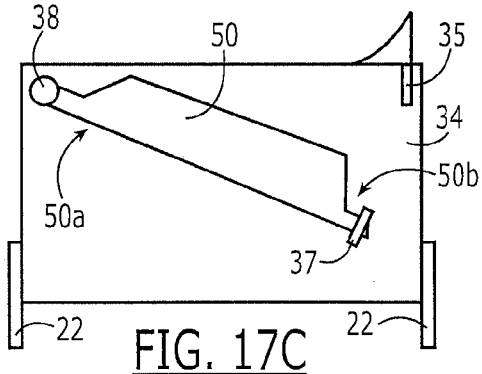
Figure 17D:
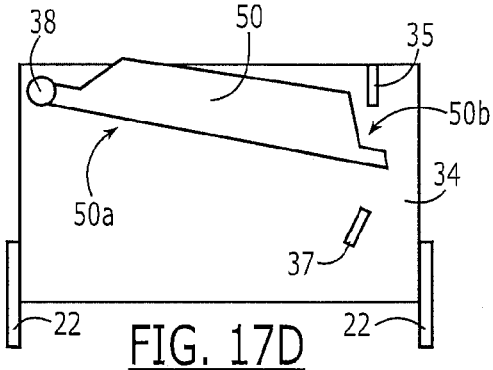
Figure 17E:
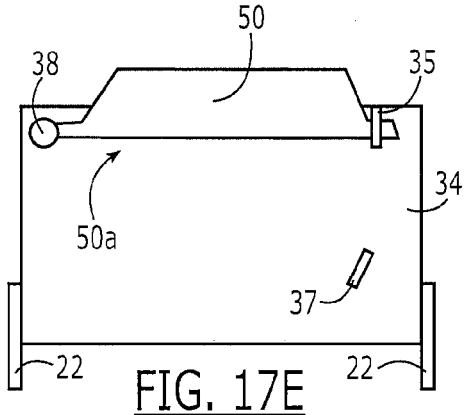

FIGS. 17*a*-17*e* illustrate another alternative embodiment of wheeled luggage that includes a pivotable tongue 50. The tongue is supported near one end 50*a* on a bushing 38 supported on the base member 34, and may be a rigid, plate-like bar to be rotatable about an axis A. An L-shaped bracket or other support 35 may be fixed to the base member 34 in position to support an opposite end 50*b* of the tongue 50 when the tongue is in the active position, as shown in FIGS. 17*b* and 17*e*. A similar L-shaped bracket or other support 37 may be fixed to the base member 34 in position to support the opposite end 50*b* of the tongue 50 when it is in the inactive position, as shown in FIG. 17*c*.

Figure 18A:
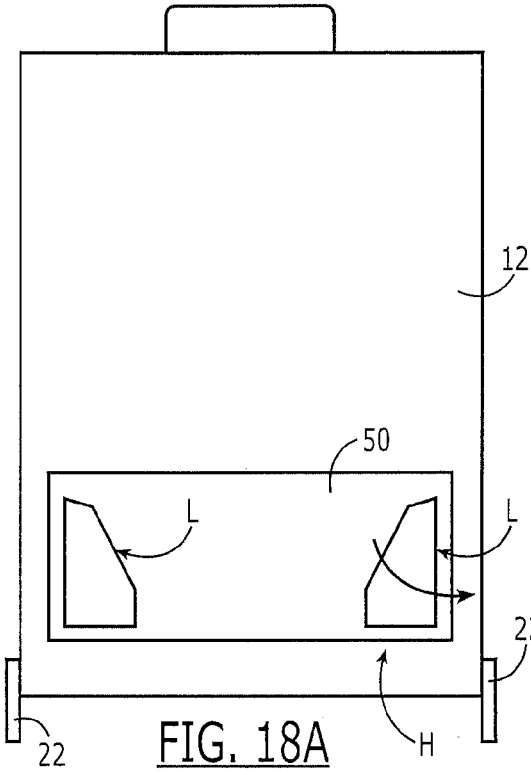
FIGS. 18*a*-18*f* illustrate another alternative embodiment of wheeled luggage that includes a hinged tongue with hinged supports.
Figure 18B:
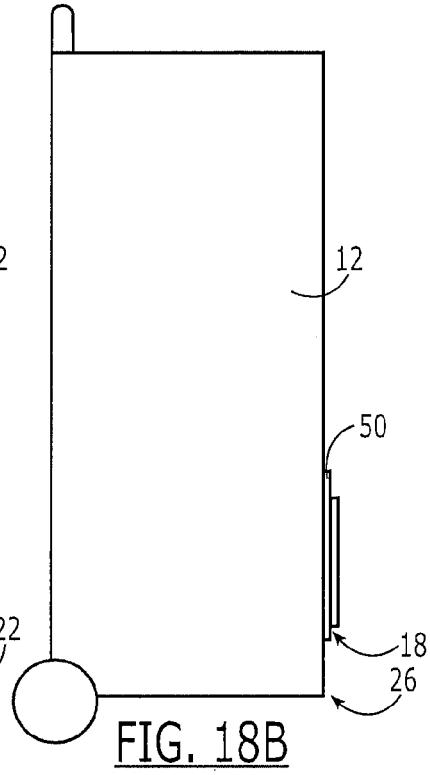
Figure 18C:
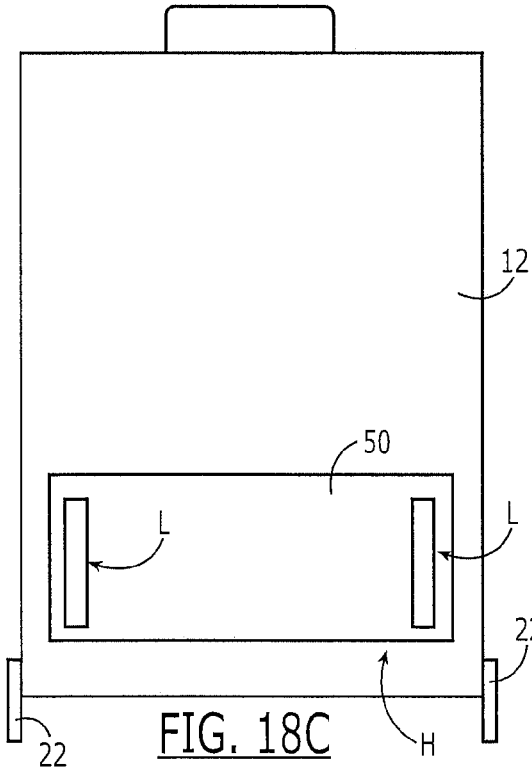
Figure 18D:
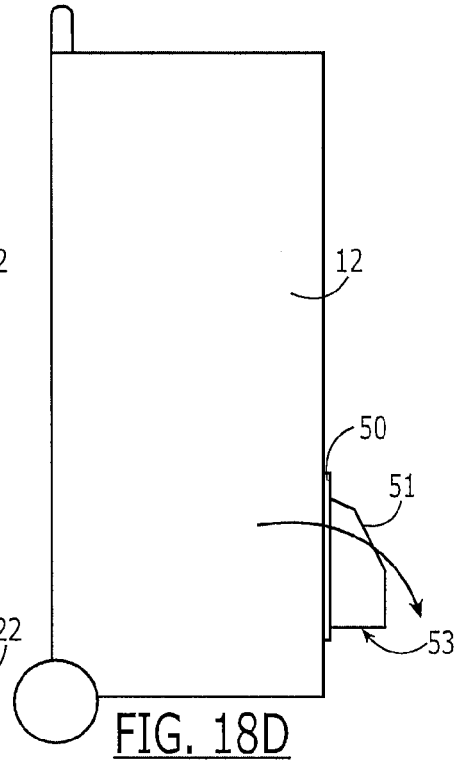
Figure 18E:
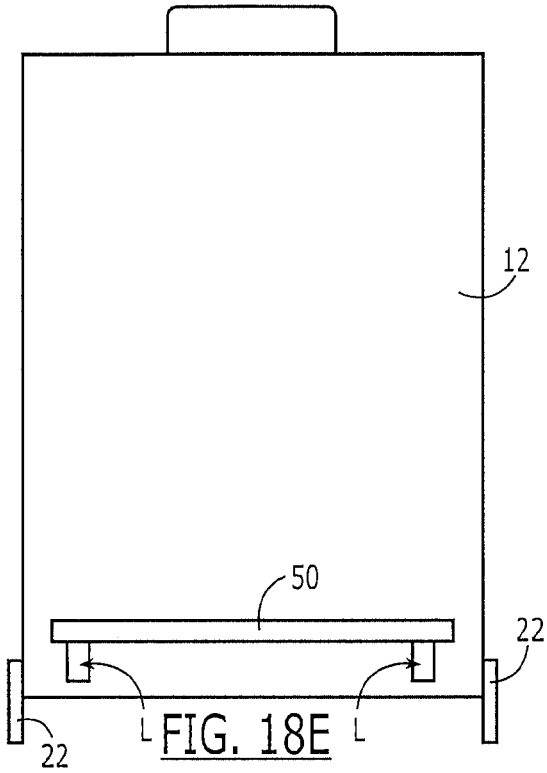
Figure 18F:
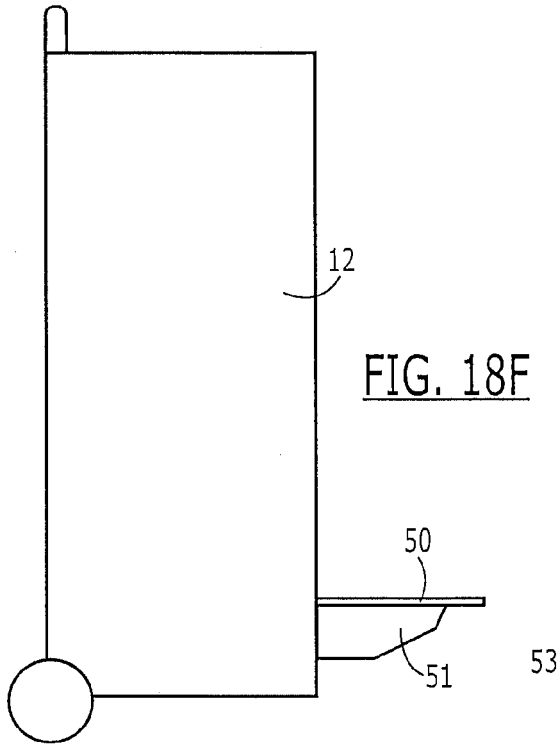

FIGS. 18*a*-18*f* illustrate another alternative embodiment of wheeled luggage that includes a hinged tongue 50 with hinged supports. In this embodiment, the tongue 50 is hingedly attached, by a hinge barrel, living hinge, fabric attachment, etc., at H to a front of the luggage body 12, as shown in FIGS. 18*a* and 18*b*. Accordingly, the tongue 50 may be positioned slightly forward of the leading edge 26 of the body even in the inactive position, as shown in FIG. 18*b*. However, because of the relatively flat configuration of the tongue 50 that prevents undesirable interference with other luggage, etc., this configuration is nevertheless considered to provide both an inactive and an active position, as defined herein, as shown in FIGS. 18*b* and 18*f*, respectively. The tongue 50 is preferably a rigid, e.g. metal or plastic, plate so that it is capable of supporting any luggage 100 stacked thereon. In this embodiment, supports 51 are hingedly attached to the tongue 50 at L, e.g. by a hinge barrel, to permit them to fold between a position substantially flat against the tongue, as shown in FIG. 18*b*, and a position in which they are substantially perpendicular to the tongue, as shown in FIGS. 18*e* and 18*f*. In the unfolded position, a stop surface 53 of the supports 51 abuts the front of the body 12 of the luggage to prevent further pivoting movement of the tongue 50, and provide adequate support for any luggage placed thereon, as best shown in FIGS. 18*e* and 18*f*.

Figure 19A:
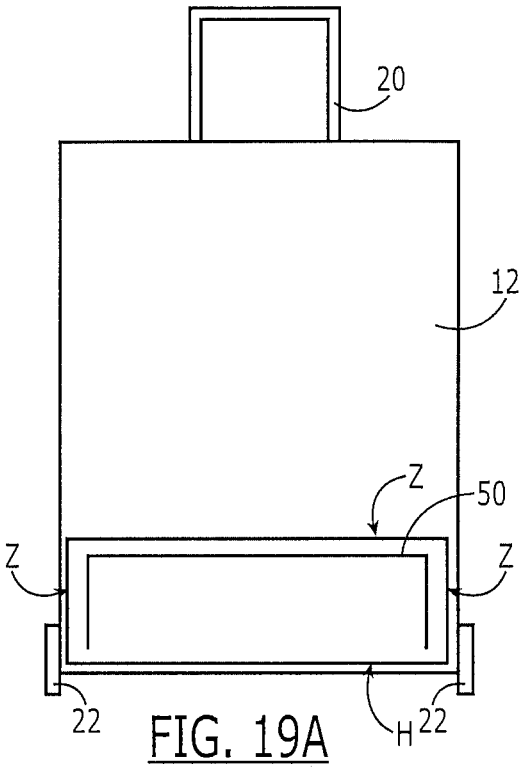
FIGS. 19*a*-19*e* illustrate another alternative embodiment of wheeled luggage that includes a zip-out hinged tongue with supports.
Figure 19B:
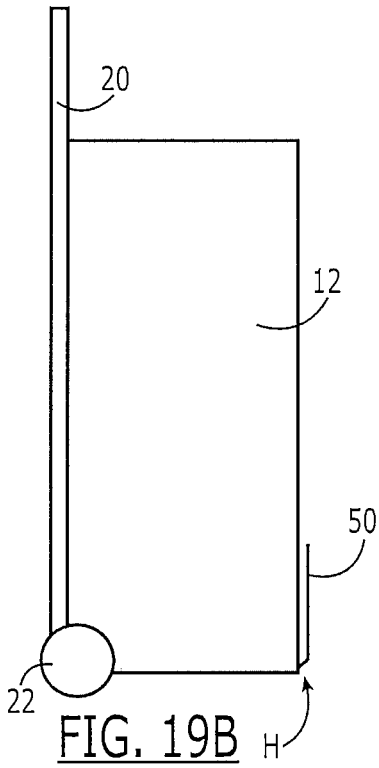
Figure 19C:
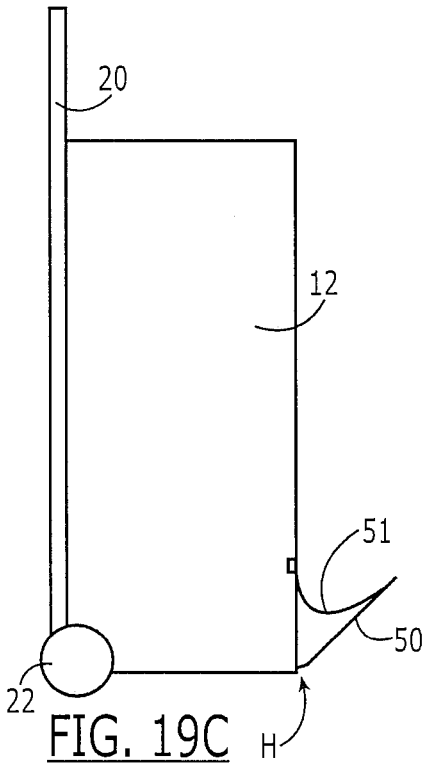
Figure 19D:
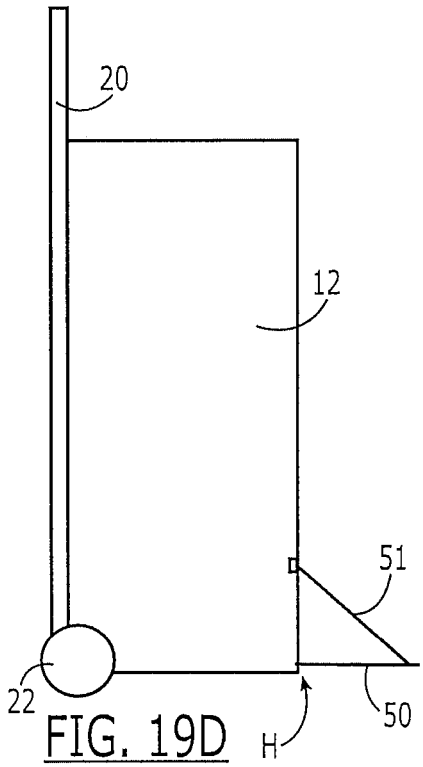
Figure 19E:
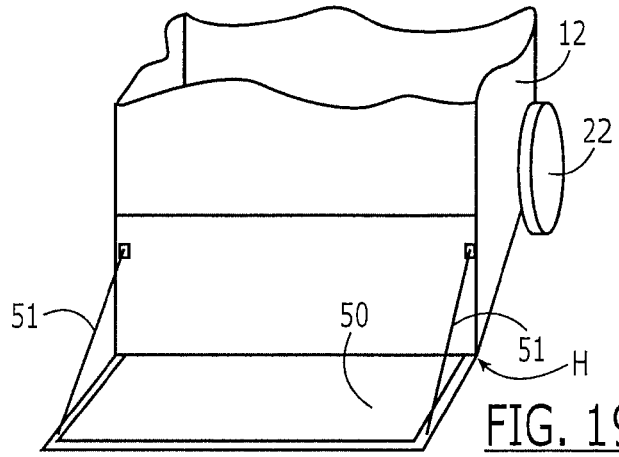

FIGS. 19*a*-19*e* illustrate another alternative embodiment of wheeled luggage that includes a zip-out hinged tongue with supports. Accordingly, the tongue 50 may be integral with and/or concealed within a fabric pocket or flap that may be joined to a remainder of the body by a zipper at Z, as shown in FIG. 19*a*. The zipper may be unzipped to permit the tongue 50 to pivot downwardly from its inactive position shown in FIGS. 19*a* and 19*b*, as shown in FIGS. 19*c* and 19*d*. The tongue 50 may be a rigid plate, bar, etc. capable of supporting additional luggage. The tongue may be attached to the front of the body 12 of the luggage 10, by a hinge barrel, living hinge, fabric attachment, etc., at H. Integral supports 51, such as cables, metal bars, plastic or fabric strips, etc. attached to both the body of the luggage and the tongue 50 to limit further pivoting beyond the active position, as shown in FIGS. 19*d* and 19*e*.

Figure 20A:
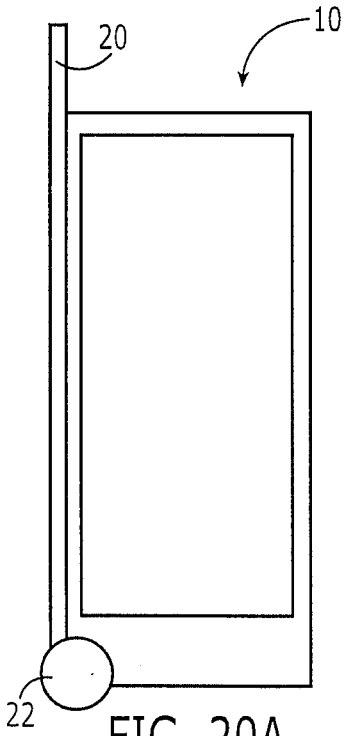
FIGS. 20*a*-20*d* illustrate a separate zip-open compartment for luggage.
Figure 20B:
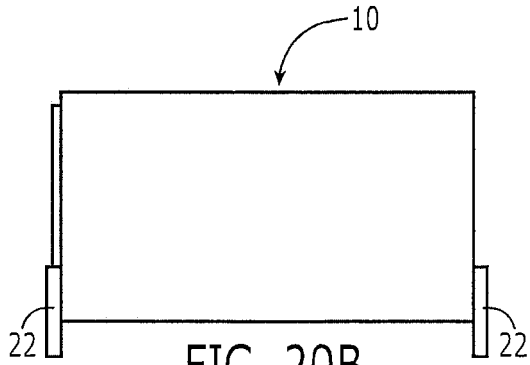
Figure 20C:
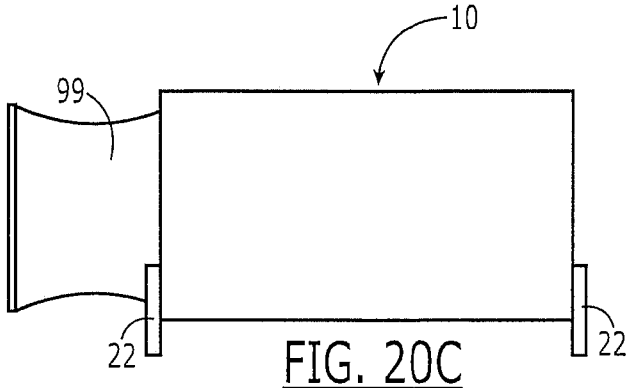
Figure 20D:
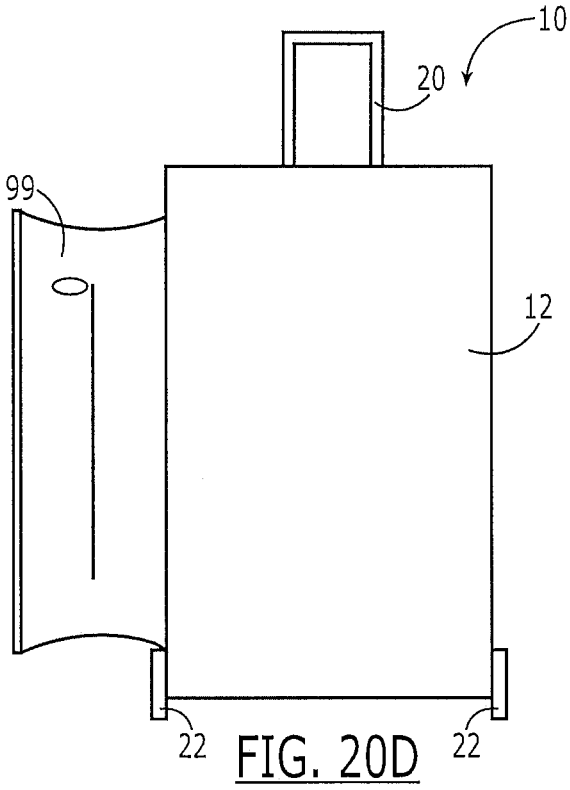

FIGS. 20*a*-20*d* show an additional feature of luggage that includes a side-mounted zip-out compartment comprising a substantially rectangular compartment having five open sides, but formed of a collapsible fabric, etc. and joined to the body by a zipper to provide a conventional zip-out arrangement, but to provide an additional, separate compartment 99 that is side mounted on the wheeled luggage, as shown in FIG. 20*a*. This compartment may be incorporated into any of the embodiments shown above.

Figure 15A:
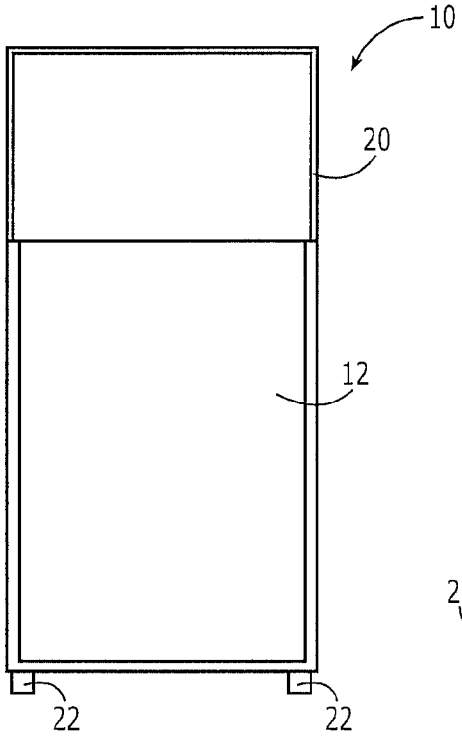
FIGS. 15*a*-15*c* illustrate an alternative embodiment of wheeled luggage that includes an angled handle.
Figure 15B:
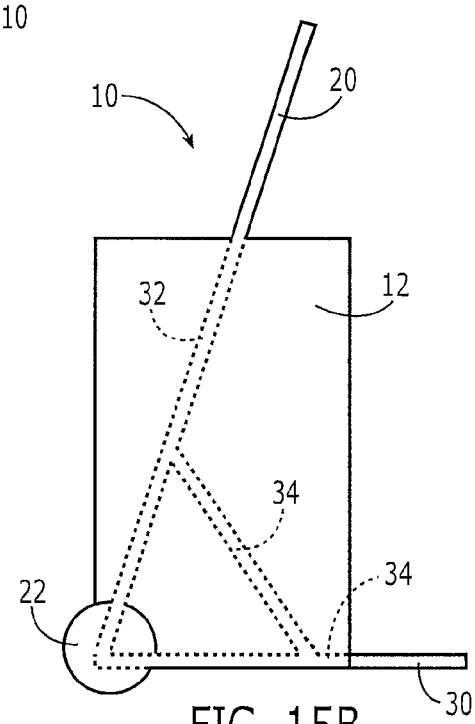
Figure 15C:
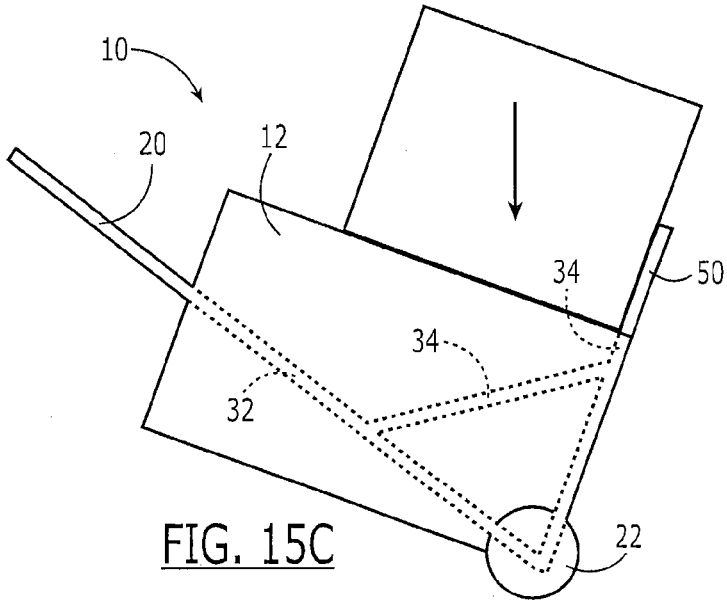

Any of these embodiments may include structures that lock/secure the tongue(s) in the open and closed position until releasing the lock manually to prevent accidental movement of tongue. Further, any of these embodiments may include an angled handle 20, as best shown in FIGS. 15*a*-15*c*. The angled handle 20 is provided by joining the upright frame member 32 to the base member 34 at an angle substantially less than 90 degrees, such as 45-75 degrees, as shown in FIG. 15*b*. Providing such an angled handle may allow for easier application of leverage to lift any additional luggage supported by the tongue, and/or provide a more comfortable handle position during toting of the wheeled luggage.

While there have been described herein the principles of the invention, it is to be understood by those skilled in the art that this description is made only by way of example and not as a limitation to the scope of the invention.

What is claimed is:

1. Wheeled luggage, comprising:

a rigid frame comprising a rigid upright member fixedly connected to a rigid base member;

a soft luggage body supported on said frame, said luggage body cooperating with said rigid frame to provide an interior space having a fixed overall shape, said luggage body comprising at least one flexible panel and a closure operable to secure the panel to enclose said interior space for receiving objects to be carried by the luggage;

a collapsible handle supported on said frame, said handle being extendable from a compact stored position to an extended operable position;

a pair of wheels fixedly supported on said frame in position to rotate about a common axis to provide rolling support for said luggage;

a tongue pivotably supported on said base member of said frame for pivotal movement about an axis normal to a plane of said base member, said tongue being movable between an inactive position, in which said tongue is positioned within a footprint defined by said body of said luggage, and an active position, in which said tongue extends beyond the footprint of said body to provide supportive structure on which an additional piece of luggage may be placed, said tongue being supported on at least one bushing disposed intermediate the length of tongue and dividing the tongue into a protruding portion and a stabilizing portion.

2. The wheeled luggage of claim 1, wherein said soft luggage body comprises a plurality of flexible panels, and wherein said soft luggage body defines a generally rectangular volume and comprises a bottom wall adjacent said base member, a top wall opposite said bottom wall, a back wall fixed to said top and bottom walls, a pair of opposing side walls fixed to said top, bottom and back walls, and a front wall securable to said top, bottom and side walls by said closure to define said interior space.

3. The wheeled luggage of claim 1, wherein said upright member is joined to said base member to form an angle between said base member and said upright member of approximately 90 degrees.

4. The wheeled luggage of claim 1, wherein said upright member is joined to said base member to form an acute angle between said base member and said upright member of approximately 45 to approximately 75 degrees.

5. The wheeled luggage of claim 1, wherein said tongue comprises a pair of bars, each supported on a respective bushings located eccentrically to said base member on said base member, each bushing supporting a respective one of said pair of bars for pivotal movement.

6. The wheeled luggage of claim 5, wherein each of said bars has a length greater than a distance between said bushings.

7. A piece of wheeled luggage, comprising:

a rigid assembly comprising:

a rigid frame comprising a rigid upright member fixedly connected to a rigid base member;

a rigid handle supported on said frame, said handle being extendable from a collapsed stored position to an extended operable position;

a pair of wheels fixedly supported on said frame in position to rotate about a common axis to provide rolling support for said luggage;

a tongue pivotably supported on said base member of said frame for pivotal movement about an axis normal to a plane of said base member, said tongue being movable between an inactive position and an active position, said tongue being supported on a bushing disposed intermediate the length of tongue and dividing the tongue into a protruding portion extending in one direction from said bushing, and a stabilizing portion extending in an opposite direction from said bushing; and a soft luggage body supported on said frame, said luggage body cooperating with said rigid frame to provide an interior space having a fixed overall shape, said luggage body comprising a plurality of flexible panels and a closure operable to secure the panels to define said interior space for receiving objects to be carried by the luggage; wherein said body defines a footprint of said luggage, and wherein said tongue extends beyond said footprint to provide supportive structure on which an additional piece of luggage may be placed when in said active position.

8. The wheeled luggage of claim 7, wherein said tongue comprises a pair of bars, each supported on a respective bushings located eccentrically to said base member on said base member, each bushing supporting a respective one of said pair of bars for pivotal movement.

9. The wheeled luggage of claim 8, wherein each of said bars has a length greater than a distance between said bushings.

* * * * *